US008372573B2

(12) United States Patent
Ayaki et al.

(10) Patent No.: US 8,372,573 B2
(45) Date of Patent: Feb. 12, 2013

(54) TONER

(75) Inventors: Yasukazu Ayaki, Yokohama (JP); Atsushi Tani, Suntou-gun (JP); Tsuneyoshi Tominaga, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/424,324

(22) Filed: Mar. 19, 2012

(65) Prior Publication Data

US 2012/0171608 A1 Jul. 5, 2012

Related U.S. Application Data

(60) Division of application No. 12/511,665, filed on Jul. 29, 2009, now abandoned, which is a continuation of application No. PCT/JP2009/053801, filed on Feb. 24, 2009.

(30) Foreign Application Priority Data

Feb. 25, 2008 (JP) ..... 2008-042969

(51) Int. Cl.
*G03G 9/093* (2006.01)

(52) U.S. Cl. ..... 430/137.11; 430/137.14; 430/137.15; 430/137.16

(58) Field of Classification Search ..... 430/137.11, 430/137.14, 137.15, 137.16
See application file for complete search history.

(56) References Cited

U.S. PATENT DOCUMENTS

| | | | |
|---|---|---|---|
| 6,020,101 | A | 2/2000 | Sacripante et al. |
| 6,210,853 | B1 | 4/2001 | Patel et al. |
| 2006/0063087 | A1 | 3/2006 | Ninomiya et al. |
| 2006/0166120 | A1 | 7/2006 | Moriki et al. |
| 2006/0204882 | A1 | 9/2006 | Nozaki et al. |
| 2006/0210899 | A1 | 9/2006 | Nakazawa et al. |
| 2006/0216625 | A1 | 9/2006 | Maehata et al. |
| 2007/0077510 | A1 | 4/2007 | Nosella et al. |
| 2007/0190442 | A1 | 8/2007 | Nakamura et al. |
| 2007/0224532 | A1 | 9/2007 | Vanbesien et al. |
| 2008/0003512 | A1 | 1/2008 | Kobayashi et al. |
| 2008/0057434 | A1 | 3/2008 | Itoh |
| 2008/0076054 | A1 | 3/2008 | Nozaki et al. |

(Continued)

FOREIGN PATENT DOCUMENTS

| | | |
|---|---|---|
| EP | 1 832 934 A1 | 9/2007 |
| JP | 06-130713 | 5/1994 |

(Continued)

OTHER PUBLICATIONS

PCT International Preliminary Report on Patentability and Written Opinion, International Application No. PCT/JP2009/053801, Mailing Date Sep. 10, 2010.

(Continued)

*Primary Examiner* — Hoa V Le
(74) *Attorney, Agent, or Firm* — Fitzpatrick, Cella, Harper & Scinto

(57) ABSTRACT

A toner in which, in a loss tangent (tan δ) curve obtained by a dynamic viscoelasticity test, the tan δ shows a maximal value δa in the temperature region of 28.0-60.0° C., which maximal value δa is 0.50 or more, and shows a minimal value δb in the temperature region of 45.0-85.0° C., which minimal value δb is 0.60 or less, where the difference between the maximal value δa and the minimal value δb is 0.20 or more; and, where the temperature that affords the maximal value δa is represented by Ta (° C.) and the temperature that affords the minimal value δb is represented by Tb (° C.), the difference between the Ta and the Tb is 5.0-45.0° C.; and the toner having, in a storage elastic modulus (G') curve obtained by the dynamic viscoelasticity test, a value G'a of a storage elastic modulus at the Ta, of $1.00\times10^6$-$5.00\times10^7$ Pa.

13 Claims, 3 Drawing Sheets

U.S. PATENT DOCUMENTS

| | | | |
|---|---|---|---|
| 2008/0096120 | A1 | 4/2008 | Yamaguchi et al. |
| 2009/0291383 | A1 | 11/2009 | Ayaki et al. |

FOREIGN PATENT DOCUMENTS

| | | | |
|---|---|---|---|
| JP | 11-288129 | | 10/1999 |
| JP | 2000-047419 | | 2/2000 |
| JP | 2002-287425 | | 10/2002 |
| JP | 2003-091093 | | 3/2003 |
| JP | 2003-330225 | | 11/2003 |
| JP | 2005-156824 | A | 6/2005 |
| JP | 2006-091168 | | 4/2006 |
| JP | 2006-235615 | | 9/2006 |
| WO | 2007/077643 | A1 | 7/2007 |

OTHER PUBLICATIONS

European Search Report dated Sep. 5, 2012 in European Application No. 09716107.9.

TONER

This application is a divisional of U.S. application Ser. No. 12/511,665, filed Jul. 29, 2009, which is a continuation of International Application No. PCT/JP2009/053801, filed Feb. 24, 2009, which claims the benefit of Japanese Patent Application No. 2008-042969, filed Feb. 25, 2008.

BACKGROUND OF THE INVENTION

1. Field of the Invention

This invention relates to a toner used in electrophotography, electrostatic recording, magnetic recording and toner jet recording.

2. Related Background Art

Conventionally, electrophotography is a process in which an image is obtained by forming an electrostatic latent image on a photosensitive member by various means, developing the latent image by the use of a toner to form a toner image on the photosensitive member, transferring the toner image to a transfer material such as paper as occasion calls, and then fixing the toner image to the transfer material by the action of heat, pressure, heat-and-pressure, solvent vapor or the like.

As the step of fixing toner images, it has been put forward to use a pressure contact heating method making use of a heating roller (hereinafter "heating roller fixing method"), a heat fixing method in which toner images are fixed bringing a fixing sheet to which toner images are to be fixed into close contact with a heating element through a fixing film (hereinafter "film fixing method"), and so forth.

In the heating roller fixing method or the film fixing method, toner images held on the fixing sheet are made to pass the surface of the heating roller or fixing film while bringing the former into contact with the latter under application of pressure by means of a pressure member kept in touch with the latter. In this fixing method, since the surface of the heating roller or fixing film and the toner images held on the fixing sheet come into contact with each other under application of pressure, the heat efficiency in fusing the toner images onto the sheet is so greatly high as to enable performance of rapid and good fixing. In particular, the film fixing method is greatly effective in energy saving, and is expected to be also effective in that, e.g., time can be short which is taken after the switch of an electrophotographic apparatus is turned on and until printing on the first sheet is completed.

Electrophotographic apparatus are variously demanded to be achievable of high image quality, compact and light weight, high-speed high-productivity, energy saving and so forth. In particular, especially in the fixing step, it is an important technical subject to develop systems and materials which can achieve much higher speed, energy saving and high reliability.

However, in order to resolve such a subject in the heating roller fixing method or film fixing method, it is essential, in particular, to vastly improve fixing performance of toners. More specifically, it is necessary to improve the performance of being sufficiently fixable to the fixing sheet at a lower temperature (hereinafter "low-temperature fixing performance") and to improve the performance of being able to prevent offset which is a phenomenon in which contamination due to toner having stuck to the surface of the heating roller or film causes contamination of a next fixing sheet (hereinafter "anti-offset performance"). Also, as performance tending to come into the relation of a trade-off for the improvement in the low-temperature fixing performance, there may be given the performance of keeping a phenomenon from occurring in which the toner comes to agglomerate or fuse during long-term storage (hereinafter "anti-blocking performance") and the performance of keeping any faulty images from coming about in continuous printing on a large number of sheets (hereinafter "development stabilizing performance").

As full-color electrophotographic apparatus have become popular, it has also become required to further improve image quality level. More specifically, what is required is the performance of keeping the toner from soaking into paper so much as to narrow its image color range (hereinafter "anti-soaking performance"). This soaking tends to occur as a lowering of image quality level that is due to heating non-uniformity coming about in the direction of progress of the fixing step between the first half and the second (latter) half of fixing, or as a lowering of image quality level that is due to heating non-uniformity between the first sheet and the 10th sheet when images are reproduced at a high speed. Also, in color toners, images having a broad image color range (hereinafter "color ranging performance") are demanded, where images having a higher image chroma or images having higher image brightness are demanded even when image densities are equal to one another. Such color ranging performance of the toner is concerned with (1) the color developing performance a colorant contained in a toner has, (2) the state of presence of the colorant in a toner, (3) the transparency of a binder resin and other components contained in a toner, (4) the surface state of toner layers formed by the fixing of toner images onto a transfer material, and so forth. In particular, it is important to form the toner layers on the transfer material in a more uniform surface state.

In toners used in heat-and-pressure fixing, a toner having a capsule structure is available as a toner which aims to achieve both the low-temperature fixing performance and the anti-blocking performance (see Japanese Patent Application Laid-open No. H06-130713). This toner is one in which inner core layers having a low glass transition point (Tg) is covered with outer shell layers having a high Tg so that any low-Tg material contained in the interiors of toner particles may be kept from exuding, so as to achieve both the low-temperature fixing performance and the anti-blocking performance or development stabilizing performance. Also, as a method of afterwards forming the outer shell layers covering the surfaces of inner core layers of toner particles, a toner is proposed the particles of which are provided with intermediate layers having a chargeability that is reverse to the chargeability of the inner core layers and outer shell layers (see Japanese Patent Application Laid-open No. 2003-091093). This toner is one in which high-Tg and high-molecular weight resin particles or inorganic particles are introduced into the intermediate layers to make the outer shell layers able to gain their weight, so as to aim to improve the anti-blocking performance and the development stabilizing performance. However, it is sought to make more improvement in low-temperature fixing performance and to make image quality higher.

For the purpose of preventing a phenomenon that toner images formed on a transfer material stain the other transfer materials, a toner is proposed in which a storage elastic modulus G' at 30° C. and a loss tangent (tan δ) at 60° C. in a dynamic viscoelasticity test have been controlled (see Japanese Patent Application Laid-open No. 2002-287425). In this toner, however, substantially the value of tan δ at 60° C. is 0.7 or more and the value of G' at 30° C. is $2\times10^8$ Pa or more. A toner is also proposed which has a minimal value and a maximal value at 70° C. or more to less than 110° C. in a loss tangent (tan δ) curve in a dynamic viscoelasticity test and in which a loss elastic modulus G" at 140° C. has been controlled (see Japanese Patent Application Laid-open No. 2006-235615). However, it is sought to make more improvement in low-temperature fixing performance and to make image quality higher.

As a toner which aims to achieve both low-temperature fixing performance and glossiness uniformity, a toner is available in which the range of change in loss elastic modulus G" in the temperature region of from 60° C. to 95° C. has been controlled (see Japanese Patent Application Laid-open No. 2006-091168). However, the toner has had an insufficient anti-soaking performance because of its great change in viscosity in that temperature region.

SUMMARY OF THE INVENTION

An object of the present invention is to provide a toner that can resolve such problems as those discussed above.

More specifically, an object of the present invention is to provide a toner having superior low-temperature fixing performance, and further having good development stabilizing performance, having good anti-soaking performance and color ranging performance and enabling formation of high-grade images.

The present invention is a toner comprising toner base particles containing at least a binder resin, a colorant and a wax, and an inorganic fine powder; in a loss tangent (tan δ) curve obtained by a dynamic viscoelasticity test of the toner, the tan δ showing a maximal value δa in the temperature region of from 28.0° C. to 60.0° C., which maximal value δa is 0.50 or more, and showing a minimal value δb in the temperature region of from 45.0° C. to 85.0° C., which minimal value δb is 0.60 or less, where the difference between the maximal value δa and the minimal value δb, δa−δb, is 0.20 or more; and, where the temperature that affords the maximal value δa is represented by Ta (° C.) and the temperature that affords the minimal value δb is represented by Tb (° C.), the difference between the Ta and the Tb, Tb−Ta, being from 5.0° C. to 45.0° C.; and the toner having, in a storage elastic modulus (G') curve obtained by the dynamic viscoelasticity test, a value G' a of a storage elastic modulus at the Ta, of from $1.00\times10^6$ Pa to $5.00\times10^7$ Pa.

According to the present invention, the toner can be obtained which has superior low-temperature fixing performance, and also having good development stabilizing performance, and having good anti-soaking performance and good color ranging performance, enabling formation of high-grade images.

Further features of the present invention will become apparent from the following description of exemplary embodiments with reference to the attached drawings.

DETAILED DESCRIPTION OF THE INVENTION

Figure 1:
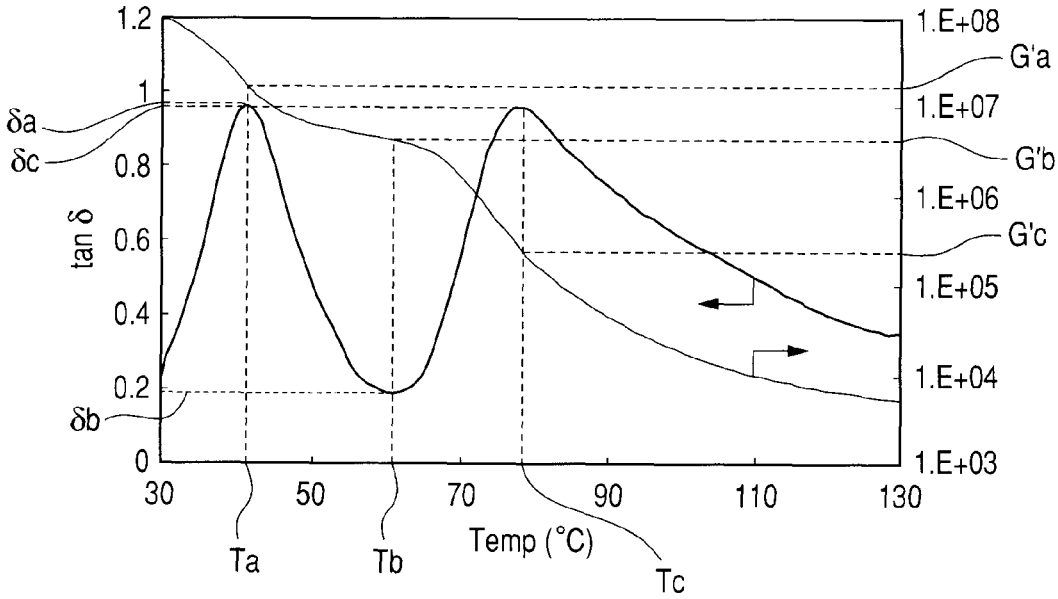
FIG. 1 is a chart showing Ta, Tb, Tc, δa, δb, δc, G'a, G'b and G'c measured by a dynamic viscoelasticity test in the present invention.
Figure 2:
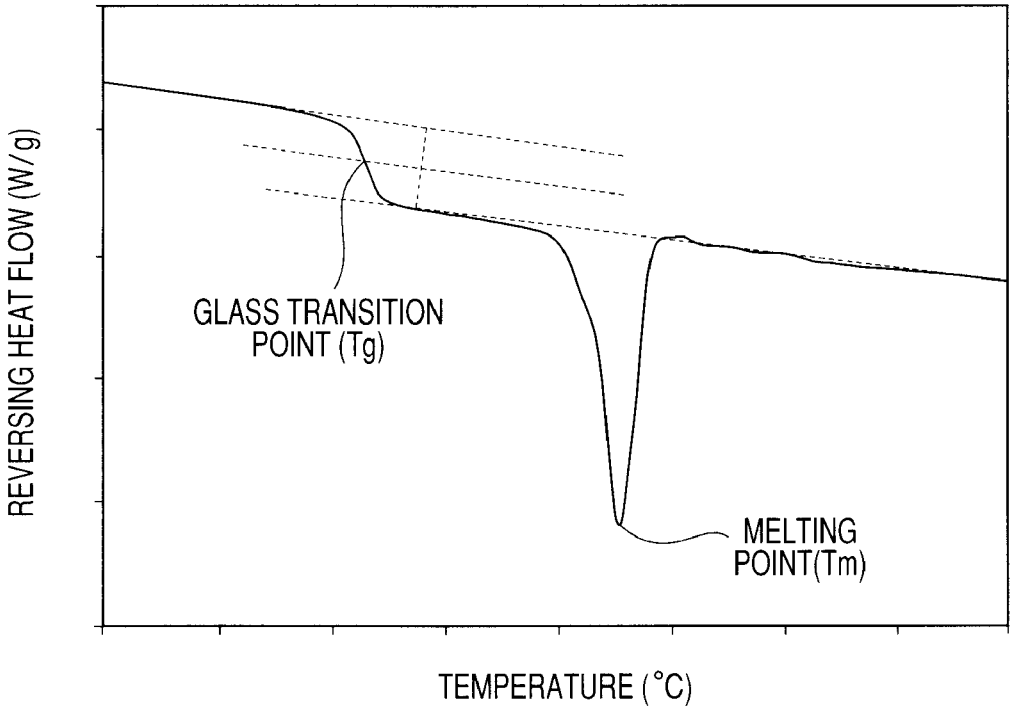
FIG. 2 is a chart showing a glass transition point (Tg) and a melting point (Tm) measured by DSC.
Figure 3:
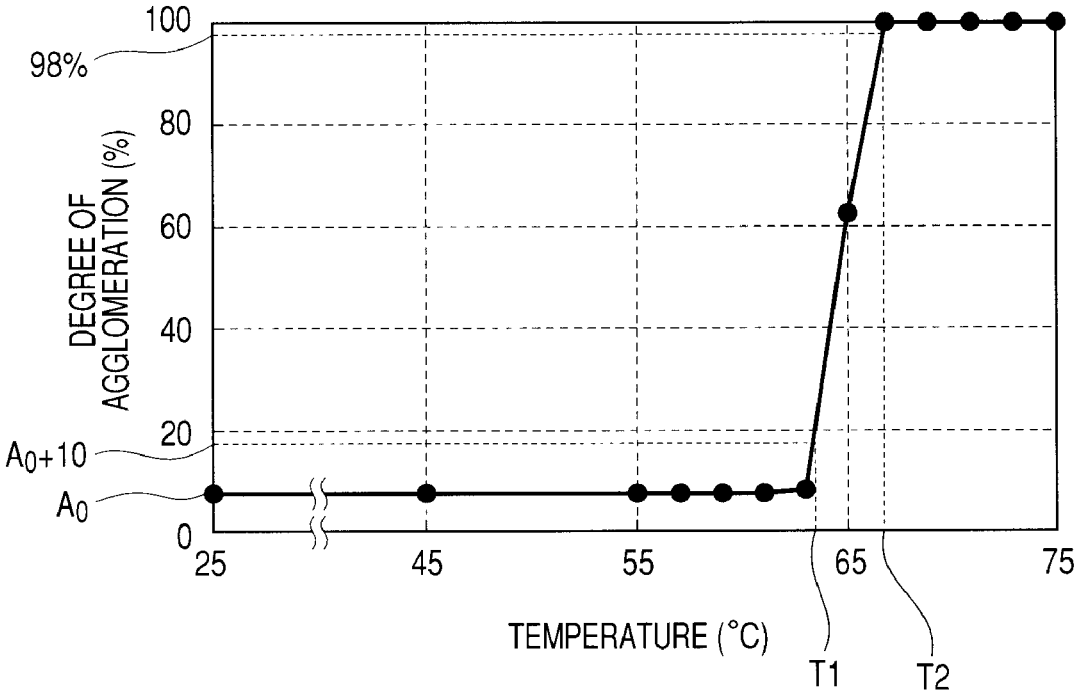
FIG. 3 is a graph showing an example of measurement of $A_0$, T1 and T2 defined in the present invention.

In the loss tangent [tan δ=G"(loss elastic modulus)/G'(storage elastic modulus)] curve obtained by a dynamic viscoelasticity test of the toner, the tan δ shows a minimal value δb in the temperature region of from 45.0° C. to 85.0° C., and the minimal value δb is 0.60 or less. Having a minimal value δb means that the toner has, in the vicinity of a temperature Tb (° C.) that affords the minimal value δb, an elasticity retention region where a lowering of the storage elastic modulus G'becomes dull. Since the lowering of the storage elastic modulus G'becomes dull, the value of G' with respect to the loss elastic modulus G" becomes relatively large, so that it appears as the minimal value δb in the tan δ curve. It may also be considered that the tan δ assumes the minimal value as a result of rapid progress of a lowering of the loss elastic modulus G". However, regarding toners and raw materials used for the toners, such a phenomenon is commonly hard to imagine. On the other hand, where the δb is more than 0.60, the toner may have no sufficient low-temperature fixing performance or, in the case of a toner showing a relatively good low-temperature fixing performance, the toner may have low anti-soaking performance and color ranging performance.

In the fixing step, once the toner on the transfer material begins being heated, the temperature of the toner rises at least up to the vicinity of the Tb. Depending on a fixing system, the toner may be heated up to the vicinity of the Tb or may be heated beyond the Tb. Where the temperature of the toner has risen up to the vicinity of the Tb, the toner comes to have a low viscosity as having the minimal value δb in the tan δ curve, but it comes to have elasticity standing retained to a certain extent. Hence, even in the toner aiming the improvement in low-temperature fixing performance, the toner is improved in the anti-soaking performance and also can well bring out the color ranging performance, as so considered. The toner can also simultaneously be improved in its anti-offset performance. In the fixing step, even where the toner is heated beyond its temperature Tb, once the toner is finished being heated, the toner is cooled from the state it is heated beyond the temperature Tb. However, from a point in time where the temperature of the toner has reached the Tb, the value of G' of the toner becomes markedly larger. At the time where fixed images are cooled in the fixing step, the toner returns faster to a high value of elasticity than conventional toners, and hence the toner can well bring out its anti-soaking performance and color ranging performance, as so considered.

In the loss tangent (tan δ) curve obtained by a dynamic viscoelasticity test of the toner, the tan δ shows a maximal value δa in the temperature region of from 28.0° C. to 60.0° C., and the maximal value δa is 0.50 or more. In the present invention, the temperature Ta (° C.) that affords the maximal value δa depends greatly on a glass transition point(s) (Tg) of a binder resin component(s) of the toner. Besides, it is also influenced by a wax and other additives contained in toner particles and by production steps. The difference between the Ta and the Tb, Tb−Ta, is from 5.0° C. to 45.0° C. Thus, once in the fixing step the toner is heated to a temperature not lower than the Ta, individual particles of the toner become relatively soft and the toner is seen to be improved in the low-temperature fixing performance, but its elasticity is retained at the temperature vicinal to the Tb. This enables the toner to be improved in its anti-soaking performance, color ranging performance and anti-offset performance. More specifically, inasmuch as the Ta is small, the fusion and deformation of toner particles at the initial stage of the fixing step are accelerated and, inasmuch as the value of (Tb−Ta) is appropriately large, the toner can be kept from having low anti-soaking performance and so forth.

The toner of the present invention also has, in a storage elastic modulus (G') curve, a value G'a of a storage elastic modulus at the Ta, of from $1.00\times10^6$ Pa to $5.00\times10^7$ Pa. Inasmuch as the G'a is in the above range, the toner can be improved in its anti-soaking performance, color ranging performance and anti-offset performance without lowering its low-temperature fixing performance when in the fixing step the toner becomes less viscous as the toner is heated. If the G'a is less than $1.00\times10^6$ Pa, in the fixing step, the toner layers heated may become less retentive on the transfer material, and the toner tends to have insufficient anti-soaking performance, color ranging performance and anti-offset performance even if the δb is in the above range. If the G'a is more than $5.00\times10^7$ Pa, in the fixing step, the toner layers heated may become greatly retentive on the transfer material, and the toner tends to have a low low-temperature fixing performance even if the δb is in the above range. Also, the toner particles come not to fuse and deform with ease, and hence the toner may have a low color ranging performance. The value of G'a, which may also be concerned with the value of (Tb−Ta), may preferably be from $3.00\times10^6$ Pa to $5.00\times10^7$ Pa, much preferably from $5.00\times10^6$ Pa to $5.00\times10^7$ Pa, and particularly preferably from $1.00\times10^7$ Pa to $4.50\times10^7$ Pa. The G' a may generally be controlled by managing the weight average molecular weight (Mw) and molecular weight distribution of a tetrahydrofuran (THF)-soluble component contained in the toner, also the wax, other additives, and/or production steps.

The range of the value of (Tb−Ta) is also concerned with the measure of the value of G'a (Pa). If the value of (Tb−Ta) is less than 5.0° C., the effect of improving the low-temperature fixing performance is not obtainable, or the toner may have low anti-soaking performance and color ranging performance. If on the other hand the value of (Tb−Ta) is more than 45.0° C., the toner may have a low development stabilizing performance, or may have a low low-temperature fixing performance. The value of (Tb−Ta) may preferably be from 5.0° C. to 35.0° C., much preferably from 10.0° C. to 30.0° C., and particularly preferably from 15.0° C. to 30.0° C.

Further, in the loss tangent (tan δ) curve obtained by a dynamic viscoelasticity test of the toner, the maximal value δa is 0.50 or more, the minimal value δb is 0.60 or less, and the difference between these, δa−δb, is 0.20 or more. The toner of the present invention is characterized by utilizing the difference in behavior between the storage elastic modulus and the loss elastic modulus. Hence, if the value of (δa−δb) is less than 0.20, the effect aimed in the present invention is not obtainable. Thus, if it is aimed to improve the low-temperature fixing performance, the toner may have low anti-soaking performance and color ranging performance, and, if it is aimed to improve the anti-soaking performance, the toner may have a low low-temperature fixing performance. Also, if the δa is less than 0.50, the loss elastic modulus G"a (Pa) at the Ta with respect to the G'a is so small that the toner may have low low-temperature fixing performance and color ranging performance. If the δb is more than 0.60, the value of G'b with respect to the loss elastic modulus G"b (Pa) at the Tb is so small that the toner may not achieve its anti-soaking performance and color ranging performance which are effects aimed in the present invention.

The δa may preferably be 5.00 or less from the viewpoint of the development stabilizing performance. As long as the δa is 5.00 or less, the toner particles can not easily come to break in a developer container, and also can be kept from causing difficulties because of any fragments of particles having broken. Thus, the δa may preferably be from 0.50 to 5.00. Further, the δa may much preferably be from 0.60 to 2.00, still much preferably from 0.70 to 1.50, and particularly preferably from 0.80 to 1.20.

The δb may preferably be 0.05 or more from the viewpoint of the development stabilizing performance. As long as the δb is 0.05 or more, the toner particles can not easily come to break in a developer container, and also the toner can well maintain its development stabilizing performance. Thus, the δb may preferably be from 0.05 to 0.60. Further, the δb may much preferably be from 0.10 to 0.60, still much preferably from 0.10 to 0.55, and particularly preferably from 0.10 to 0.50.

The value of (δa−δb) may preferably be 5.00 or less from the viewpoint of the development stabilizing performance. As long as it is 5.00 or less, the toner can sufficiently be kept from changing in physical properties against any temperature changes, and can have a higher development stabilizing performance. Thus, the value of (δa−δb) may preferably be from 0.20 to 5.00. Further, the value of (δa−δb) may much preferably be from 0.20 to 2.00, still much preferably from 0.20 to 1.00, and particularly preferably from 0.40 to 0.90.

The Ta, Tb, δa, δb and G' a may be controlled by managing the glass transition point (Tg), weight average molecular weight (Mw) and/or molecular weight distribution of a THF-soluble component contained in the toner, also composition, the melting point of wax, and/or toner production conditions.

In the present invention, as means for controlling the Ta, Tb, δa, δb and G'a, it is preferable to incorporate toner particles with an elastic material. As the elastic material, usable are resins such as vinyl resins, polyester, polyurethane, polyurea, polyamide and polyimide, as well as fine titanium oxide powder, fine silica powder and fine alumina powder.

As methods for incorporating toner particles with the elastic material, the following are available.

(1) A method in which a binder resin, a colorant, a wax and other additives and the elastic material are dissolved or dispersed together and thereafter the toner particles are formed.

(2) A method in which colored particles containing a binder resin, a colorant, a wax and other additives are formed and thereafter coat layers of the elastic material are formed on the surfaces of the colored particles.

Of these, the method (2) is preferred. Further, a method is particularly preferred in which elastic material particles are made to adhere to the surfaces of colored particles to form coat layers. It is much preferable that the step of making the elastic material particles adhere to the surfaces of colored particles is carried out in an aqueous medium. It is also preferable for the colored particles to contain a polyester in the vicinity of their particle surfaces.

As the elastic material, it is particularly preferable to use a polar resin. Stated specifically, one having its glass transition point in the vicinity of the desired temperature Ta may be used as the binder resin of the toner, and one having its glass transition point in the vicinity of the desired temperature Tb may be used as the elastic material. It, however, is not the case that the temperature of the glass transition point of the elastic material and the temperature of the Tb come into complete agreement with each other. The Tb is influenced by, e.g., the state of presence of the elastic material in toner particles. It is preferable that in the toner particles the binder resin and the elastic material are present in the state they are phase-separated, that the elastic material is in a content of stated range based on the total mass of the toner and that the elastic material contained in individual particles of the toner is in a uniform proportion. In such a case, the Ta, Tb, δa, δb and G' a can readily be controlled within the range specified in the present invention. It is further preferable that, in comparison of individual particles of the toner, the elastic material contained in individual toner particles is present therein in a uniform state. Inasmuch as the content and state of presence of the elastic material contained in individual toner particles are uniform, the elastic material can well bring out its properties even where the elastic material is in a small content, as so considered.

Since the elastic material contained in the toner can be in a small content, the value of G" (Pa) in the temperature region in the vicinity of the Tb can be kept from increasing in the loss tangent (G") curve obtained by a dynamic viscoelasticity test. In virtue of this, the toner can well bring out its anti-soaking performance, color ranging performance and anti-offset performance without having any low low-temperature fixing performance, as so considered. Even where the elastic material is in a content of favorable range, based on the total mass of the toner, the δb tends to be a value of more than 0.60 if the content and state of presence of the elastic material in individual particles of the toner are greatly non-uniform. In this case, the toner tends to have low anti-soaking performance and anti-offset performance.

In the present invention, the elastic material may preferably be in a content of from 1.0% by mass to 25.0% by mass based on the total mass of the toner. As long as the elastic material is in a content within the above range, the δb may be controlled with ease and the toner can be more improved in its anti-soaking performance and anti-offset performance. Also, the value of G' a can be kept from increasing, and the toner can be more improved in its low-temperature fixing performance. The elastic material may much preferably be in a content of from 2.0% by mass to 12.0% by mass, and particularly preferably from 2.0% by mass to 9.0% by mass, based on the total mass of the toner.

The toner particles (toner base particles) the toner of the present invention has may preferably have a structure wherein, as mentioned above, the surfaces of colored particles are coated with the elastic material. Where the toner particles have such a structure, the thickness of coat layers formed of the elastic material may be controlled in order to control the content of the elastic material the toner particles may have. This enables its content to be readily so controlled as to be uniform between the toner particles.

In the case when elastic material particles are made to adhere to the surfaces of colored particles to form coat layers, the particle diameter of the elastic material particles may be controlled to control the thickness of the coat layers. This enables uniform formation of the coat layers on the surfaces of colored particles even when the elastic material the toner particles have is in a small content, and the toner can well bring out its development stabilizing performance, anti-soaking performance, color ranging performance and anti-offset performance. Also, since the elastic material the toner particles contain can be in a small content, the toner can be kept from having a low low-temperature fixing performance.

The elastic material may preferably be a polar resin having an anionic hydrophilic functional group. That the elastic material has an anionic hydrophilic functional group is preferable in view of improvements in the low-temperature fixing performance, anti-blocking performance, development stabilizing performance, anti-offset performance and anti-soaking performance of the toner. Inasmuch as it has the anionic hydrophilic functional group, it can have a good affinity for the binder resin in the toner, thus the content of the elastic material can readily be uniform between toner particles. Also, in the case when the toner particles the toner of the present invention has have the structure wherein the surfaces of colored particles are coated with the elastic material, the use of the elastic material having the anionic hydrophilic functional group makes it more easy to uniform the state of coating with the elastic material over the colored particles.

As a preferable anionic hydrophilic functional group the elastic material may have, usable are a sulfonic acid group, a carboxylic acid group, a phosphoric acid group and a metal salt or alkyl ester of any of these. The metal salt may include, e.g., alkali metals such as lithium, sodium and potassium, and alkaline earth metals such as magnesium. In particular, from the viewpoint of adherence between the colored particles and the elastic material and uniformity of the state of coating, it is preferable for the elastic material to have a sulfonic acid type functional group selected from a sulfonic acid group, an alkali metal salt of the sulfonic acid group and an alkyl ester of the sulfonic acid group. In this case, the state of coating with the elastic material over the colored particles can be especially uniform even where the elastic material is added in a small quantity.

The sulfonic acid type functional group the elastic material may have may preferably be in such an amount that the sulfonic acid type functional group is in a content of from 0.10% by mass to 10.00% by mass based on 100.00% by mass of the elastic material. That the content of the sulfonic acid type functional group is in the above range is preferable in view of overall achievement of the low-temperature fixing performance, anti-blocking performance, development stabilizing performance, anti-offset performance and anti-soaking performance of the toner. Where the content of the sulfonic acid type functional group is in the above range, the state of coating with the elastic material over the colored particles can be especially uniform even where the elastic material is added in a small quantity, and the toner can have a better development stabilizing performance. The sulfonic acid type functional group may much preferably be in a content of from 0.10% by mass to 5.00% by mass, still much preferably from 0.50% by mass to 3.50% by mass, and particularly preferably from 0.50% by mass to 3.00% by mass.

The elastic material may have a weight average molecular weight (Mw) of from 9,000 to 100,000 in terms of polystyrene as measured by gel permeation chromatography (GPC). This is preferable because the toner particles can well be kept from breaking. This also enables the toner to be more improved in its low-temperature fixing performance, anti-blocking performance, development stabilizing performance, color ranging performance, anti-offset performance and anti-soaking performance. The elastic material may much preferably have a weight average molecular weight of from 10,000 to 80,000, and still much preferably from 12,000 to 70,000.

The elastic material may also have a number average molecular weight (Mn) of from 2,000 to 20,000 in terms of polystyrene as measured by GPC. This is preferable because the toner particles can well be kept from breaking. This also enables the toner to be more improved in its low-temperature fixing performance, anti-blocking performance, development stabilizing performance, color ranging performance, anti-offset performance and anti-soaking performance. The elastic material may much preferably have a number average molecular weight of from 2,000 to 12,000, and still much preferably from 3,000 to 10,000.

The elastic material may have a ratio of the Mw to the Mn, Mw/Mn, of from 1.20 to 20.00. This is preferable because the toner can be more improved in its low-temperature fixing performance, anti-blocking performance, development stabilizing performance, color ranging performance, anti-offset performance and anti-soaking performance. The elastic material may much preferably have a ratio Mw/Mn of from 2.00 to 10.00, and still much preferably from 3.00 to 8.00.

In the case when the particulate elastic material (elastic material particles) is used to coat the surfaces of colored particles therewith, it is preferable for the elastic material to have an acid value Avp of from 6.0 mgKOH/g to 80.0 mgKOH/g, a volume average particle diameter Dvp of from 10 nm to 200 nm, and a ratio of the Avp to the Dvp, Avp×Dvp, of from 200 to 6,000. Inasmuch as the elastic material has acid value in the above range, its acid groups can readily interact with the surfaces of colored particles. Also, inasmuch as the elastic material has particle diameter in the above range, the elastic material contained in individual particles of the toner can readily be in a uniform quantity between toner particles while limiting the amount of the elastic material to be added, held in the whole toner. As the result that the acid value and the volume average particle diameter have been so controlled as to satisfy the above prescription, the toner can readily have better anti-soaking performance, anti-offset performance and low-temperature fixing performance. Then, the Avp may much preferably be from 10.0 mgKOH/g to 55.0 mgKOH/g, and particularly preferably from 15.0 mgKOH/g to 45.0 mgKOH/g. The Dvp may also much preferably be from 10 nm to 150 nm, and particularly preferably from 15 nm to 70 nm. Further, the value of (Avp×Dvp) may much preferably be from 200 to 3,000, still much preferably from 200 to 1,600, and particularly preferably from 300 to 1,000.

In the present invention, a method is particularly preferable in which colored particles containing a binder resin, a colorant, a wax and other additives are formed and thereafter elastic material particles are made to adhere to the surfaces of the colored particles to form coat layers of the elastic material thereon to make up toner particles.

In such a case, the elastic material may preferably have a ratio of volume distribution 10% particle diameter ($Dv_{10}$) to the above Dvp, $Dvp/Dv_{10}$, of from 1.0 to 5.0. The elastic material contained in individual particles of the toner can readily be in a uniform quantity between toner particles even if the amount of the elastic material to be added, held in the whole toner, is not increased. In this case, the toner can readily have good anti-soaking performance and anti-offset performance. Also, in the fixing step, the elastic material and the binder resin are compatible with each other so readily that the toner can have better anti-soaking performance, color ranging performance and anti-offset performance. The value of ($Dvp/Dv_{10}$) may much preferably be from 1.0 to 4.0, and particularly preferably from 1.0 to 3.0.

The elastic material may also preferably have a ratio of volume distribution 90% particle diameter ($Dv_{90}$) to the above Dvp, $Dv_{90}/Dvp$, of from 1.0 to 5.0. As long as it has the value of ($Dv_{90}/Dvp$) in this range, the elastic material can not easily come liberated from the toner particle surfaces, and hence the toner can readily have good development stabilizing performance. The toner can also have good properties in respect of its anti-soaking performance and anti-offset performance as well. The value of ($Dv_{90}/Dvp$) may much preferably be from 1.0 to 4.0, and particularly preferably from 1.0 to 3.0.

The volume average particle diameter (Dvp), volume distribution 10% particle diameter ($Dv_{10}$) and volume distribution 90% particle diameter ($Dv_{90}$) of the elastic material may be measured with, e.g., MICROTRAC UPA MODEL:9232 (manufactured by Leeds and Northrup Co.). As measuring conditions, conditions shown below are set.

Particle material: Latex
Transparent particles: Yes
Spherical particles: Yes
Particle refractive index: 1.59
Fluid: Water The elastic material may preferably have a zeta potential (Z1p) of from −110.0 mV to −35.0 mV. The Z1p is considered to be due to the type of acid groups the elastic material has, its content, and the particle diameter of fine particles of the elastic material. Inasmuch as it has Z1p in the above range, the colored particles the toner has and the elastic material can be of better adherence to each other, and also the state of coating with the elastic material, with which the colored particles are coated, can be more uniform. Still also, even where, in water, the surfaces of the colored particles coated with the elastic material to form toner particles, any elastic material having come liberated from toner particles or any agglomerates of the elastic material can be kept from being formed. The elastic material may much preferably have Z1p in the range of from −90.0 mV to −50.0 mV, and still much preferably from −85.0 mV to −60.0 mV.

The elastic material may preferably have, where 10% zeta potential and 90% zeta potential which are found by zeta potential measurement of a laser trap electrophoresis system are represented by $Z_{p10}$ (mV) and $Z_{p90}$ (mV), respectively, a ratio of the $Z_{p10}$ and the Z1p, $Z1p/Z_{p10}$, of from 1.00 to 3.00 and a ratio of the $Z_{p90}$ and the Z1p, $Z_{p90}/Z1p$, of from 1.00 to 3.00. Inasmuch as it has the values of $Z1p/Z_{p10}$ and $Z_{p90}/Z1p$ in the above ranges, the state of coating with the elastic material at the toner particle surfaces can be more uniform even where the amount of the elastic material to be added, held in the whole toner, is limited. Also, the elastic material contained in individual particles of the toner can readily be in a uniform quantity between toner particles. Where, in water, the elastic material is made to adhere to the colored particles to form coat layers formed of the elastic material, the state of coating with the elastic material can be more uniform and any agglomerates of elastic material particles one another can be kept from being formed as by-products. Hence, the elastic material having such zeta potential ratios are particularly preferable. The value of $Z1p/Z_{p10}$ may much preferably be from 1.00 to 2.50, and particularly preferably from 1.00 to 2.00. The value of $Z_{p90}/Z1p$ may also much preferably be from 1.00 to 2.50, and particularly preferably from 1.00 to 2.00.

The elastic material may contain 80.0% by mass or more of a tetrahydrofuran (THF)-soluble component and 70.0% by mass or more of a methanol-insoluble component. This is preferable in view of achievement of both the low-temperature fixing performance and the development stabilizing performance of the toner. Satisfying such prescription brings a good affinity between the binder resin and the elastic material to make more uniform the content of the elastic material contained in individual particles of the toner. In particular, in taking the make-up where the surfaces of colored particles are coated with the elastic material, the layer thickness of coat layers of the elastic material with which the colored particles are coated can be uniform to make the toner better bring out its low-temperature fixing performance and development stabilizing performance. The toner can also be good in respect of its anti-blocking performance, anti-soaking performance and color ranging performance as well. The THF-soluble component may much preferably be in a content of 85.0% by mass or more, and still much preferably 87.0% by mass or more. The THF-soluble component may particularly preferably be in a content of from 87.0% by mass to 99.0% by mass. Also, the methanol-insoluble component may much preferably be in a content of 75.0% by mass or more, and still much preferably 85.0% by mass or more. The methanol-insoluble component may particularly preferably be in a content of from 85.0% by mass to 99.0% by mass.

The methanol-insoluble component the elastic material may have may preferably have an acid value Avp2 (mgKOH/g) of from 3.0 mgKOH/g to 30.0 mgKOH/g, and a ratio between the Avp2 and the above Avp, Avp/Avp2, of from 1.00 to 5.00. In this case, the layer thickness of the elastic material in the toner particles can readily be uniform, and the toner can be more improved in its development stabilizing performance, anti-soaking performance and color ranging performance. The Avp2 may much preferably be from 5.0 mgKOH/g to 25.0 mgKOH/g, and still much preferably from 10.0 mgKOH/g to 23.0 mgKOH/g. Also, the value of Avp/Avp2 may much preferably be from 1.00 to 3.00, and still much preferably from 1.10 to 2.00.

As the resin usable as the elastic material, any resin may be used which is the same as any of those exemplified as resins usable in the binder resin described later.

In particular, a polyester having an alcohol having an ether linkage as a dihydric alcohol component may preferably be used as the elastic material. As the dihydric alcohol having an ether linkage, it may specifically include bisphenol-A alkylene oxide addition products such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane and polyoxypropylene(6)-2,2-bis(4-hydroxyphenyl)propane; diethylene glycol, triethylene glycol, dipropylene glycol, polyethylene glycol, polypropylene glycol, polytetramethylene glycol and a bisphenol-A derivative represented by the following formula (1); or a compound represented by the following formula (2).

Formula (1)

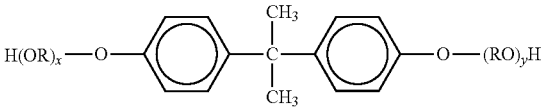

wherein R represents an ethanediyl group or a propylene-1,2-diyl group, x and y each represent an integer of 1 or more, and the average value of x+y represents 2 to 10.

Formula (2)

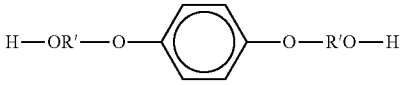

wherein R' represents a straight-chain or branched alkanediyl group.

That the elastic material has as a dihydric alcohol component the polyester having an alcohol having an ether linkage is preferable in view of overall achievement of the low-temperature fixing performance, anti-blocking performance, development stabilizing performance, anti-offset performance and anti-soaking performance of the toner. Inasmuch as it has the ether linkage in a large number at the backbone chain, it has appropriate affinity for the colored particles, and hence the elastic material can readily be in a uniform quantity between toner particles even if the elastic material is in a small quantity. Also, where the toner of the present invention has the structure that it has the colored particles and the elastic material with which the colored particles stand coated, the state of coating with the elastic material over the colored particles can readily be more uniform.

A polybasic carboxylic acid component used in combination with the above dihydric alcohol may include the following compounds: Aromatic dicarboxylic acids such as phthalic acid, isophthalic acid and terephthalic acid, or anhydrides thereof; alkyldicarboxylic acids such as succinic acid, adipic acid, sebacic acid and azelaic acid, or anhydrides thereof; succinic acids substituted with an alkyl group having 6 to 12 carbon atoms, or anhydrides thereof; and unsaturated dicarboxylic acids such as fumaric acid, maleic acid and citraconic acid, or anhydrides thereof; and n-dodecenylsuccinic acid, iso-dodecenylsuccinic acid and trimellitic acid.

The toner particles (toner base particles) that constitute the toner of the present invention may preferably be formed through the step of forming a liquid dispersion in which the colored particles containing a binder resin, a colorant and a wax stand dispersed in an aqueous medium having a sparingly water-soluble inorganic dispersant; the step of adding the elastic material to the liquid dispersion of the colored particles to form a composite liquid dispersion; the step of heating the composite liquid dispersion; and the step of dissolving the sparingly water-soluble inorganic dispersant in the composite liquid dispersion. As having the sparingly water-soluble inorganic dispersant, the surfaces of the colored particles can uniformly be coated with the inorganic dispersant in the aqueous medium. After this state has been formed, the elastic material is added in the step of forming the composite liquid dispersion, and this makes an adsorption force act by the mutual action between the inorganic dispersant and the elastic material, so that the surfaces of the colored particles can be coated with the elastic material through the inorganic dispersant in a uniform state, and in a uniform content between the colored particles. After the state has been formed in which the inorganic dispersant and the elastic material have uniformly adsorbed on the colored particles, the colored particles and the elastic material are softened by the step of heating the composite liquid dispersion. Further, while the softened state is maintained, the inorganic dispersant is dissolved in the step of dissolving the inorganic dispersant. Thus, the surfaces of the colored particles can be coated with the elastic material in a uniform state and in such a way that the quantity of the elastic material and the state of coating can be uniform between the colored particles.

Further, it is preferable to use colored particles containing a polyester resin. Inasmuch as the colored particles contain a polyester, by the mutual action with the polyester the inorganic dispersant comes adsorbed on the surfaces of the colored particles in a uniform state, and in a uniform adsorption level between the colored particles. Further, the adsorption force acts by the mutual action between the inorganic dispersant and the elastic material, thus the surfaces of the colored particles can be coated with the elastic material in a uniform state, and in a uniform content between the colored particles.

In the step of forming the liquid dispersion of the colored particles, the colored particles may preferably have a weight average particle diameter D4t of from 3.0 μm to 8.0 μm, and have a ratio of number average particle diameter D1t of the colored particles to the D4t, D4t/D1t, of from 1.00 to 1.30. Where the colored particles have D4t in the above range, the toner particles can well be kept from agglomerating one another when the coat layers are formed by the elastic material. Also, the adherence between the colored particles and the elastic material can be so appropriate as to enable the elastic material to be well kept from coming off the colored particles at the surfaces of the toner particles. Similarly, where the colored particles have the value of (D4t/D1t) in the above range, the toner particles can well be kept from agglomerating one another when the coat layers are formed by the elastic material. The value of (D4t/D1t) is an index showing the degree of distribution of particle diameters, and shows 1.00 when particles are perfectly monodisperse. It shows that, the larger than 1.00 this value is, the broader the distribution of particle diameters is. The D4t may much preferably be from 3.0 μm to 7.0 μm, and still much preferably from 4.0 μm to 6.0 μm. The value of (D4t/D1t) may also much preferably be from 1.00 to 1.25, and still much preferably from 1.00 to 1.20.

In the step of forming the liquid dispersion of the colored particles, the colored particles may preferably have an inorganic dispersant on their surfaces and have, as to a dispersoid (dispersion phase) having the colored particles and the inorganic dispersant, a zeta potential Z2t (mV) of −15.0 mV or less (negatively large) and a difference between the Z2t and the above Z1p, Z2t−Z1p, of from 5.0 mV to 50.0 mV. Where they have Z2t of −15.0 mV or less, the toner particles can well be kept from agglomerating one another when the coat layers are formed by the elastic material, and the toner can achieve better development stabilizing performance. As long as they have the value of (Z2t−Z1p) in the above range, the state of coating with the elastic material at toner particle surfaces can be more uniform. Also, the elastic material can be kept from coming off the colored particles at the toner particle surfaces. Further, fine particles of the elastic material can well be made fast to the colored particles at the surfaces of toner particles, and any liberated fine particles of the elastic material can be kept from coming about. The Z2t may much preferably be from −60.0 mV to −15.0 mV, still much preferably from −50.0 mV to −35.0 mV, and particularly preferably from −45.0 mV to −35.0 mV. The value of (Z2t−Z1p) may much preferably be from 20.0 mV to 45.0 mV, still much preferably from 25.0 mV to 45.0 mV, and particularly preferably from 30.0 mV to 45.0 mV.

The colored particles may preferably contain a styrene-acrylic resin as a chief component (binder resin), and further a polyester in an amount of from 2.0 parts by mass to 20.0 parts by mass based on 100 parts by mass of the binder resin. Inasmuch as the colored particles contain the polyester, the inorganic dispersant comes adsorbed on the surfaces of the colored particles in a uniform state, and in a uniform adsorption level also between the colored particles one another. Further, the adsorption force acts by the mutual action between the inorganic dispersant and the elastic material, thus the surfaces of the colored particles can be coated with the elastic material in a uniform state through the inorganic dispersant the particles of which stand arranged uniformly. The same can also be coated with the elastic material in a uniform content between the colored particles. The polyester may much preferably be in a content of from 3.0 parts by mass to 15.0 parts by mass, and still much preferably from 4.0 parts by mass to 10.0 parts by mass, based on 100 parts by mass of the binder resin.

In the above step of fastening treatment, in order to keep the toner particles from fusing one another, it is also preferable to add a surface-active agent or the above sparingly water-soluble inorganic dispersant. It may preferably be added in an amount of from 0.01 part by mass to 5.00 parts by mass based on 100 parts by mass of the toner particles to be obtained. The surface-active agent that may be used may include the following.

As an anionic surface-active agent, it may include, e.g., alkylbenzenesulfonates, α-olefinsulfonates, phosphates, and one having a fluoroalkyl group. The anionic surface-active agent having a fluoroalkyl group may include, e.g., fluoroalkyl carboxylic acids having 2 to 10 carbon atoms, or metal salts thereof, disodium perfluorooctane sulfonyl glutamate, sodium 3-[omega-fluoroalkyl(6 to 11 carbon atoms)oxy]-1-alkyl(3 or 4 carbon atoms)sulfonates, sodium 3-[omega-fluoroalkanoyl(6 to 8 carbon atoms)-N-ethylamino]-1-propane sulfonates, fluoroalkyl (11 to 20 carbon atoms) carboxylic acids or metal salts thereof, perfluoroalkyl(7 to 13 carbon atoms) carboxylic acids or metal salts thereof, perfluoroalkyl (4 to 12 carbon atoms) sulfonic acids or metal salts thereof, perfluorooctane sulfonic acid diethanol amide, N-propyl-N-(2-hydroxyethyl)perfluorooctane sulfonamide, perfluoroalkyl(6 to 10 carbon atoms) sulfonamide propyltrimethylammonium salts, perfluoroalkyl(6 to 10 carbon atoms)-N-ethylsulfonyl glycine salts, and monoperfluoroalkyl(6 to 16 carbon atoms) ethylphosphates.

Commercially available products of the anionic surface-active agent having such a fluoroalkyl group may include, e.g., SURFLON S-111, S-112, S-113 (available from Asahi Glass Co., Ltd.); FLUORAD FC-93, FC-95, FC-98, FC-129 (available from Sumitomo 3M Limited); UNIDYNE DS-101, DS-102 (available from Daikin Industries, Ltd.); MEGAFAC F-110, F-120, F-113, F-191, F-812, F-833 (available from Dainippon Ink & Chemicals, Incorporated); F top EF-102, 103, 104, 105, 112, 123A, 123B, 306A, 501, 201, 204 (available from Tochem Products Co., Ltd.); and FTERGENT F-100, F-150 (available from NEOS Company Limited).

As a cationic surface-active agent, it may include, e.g., amine salt type surface-active agents and quaternary ammonium salt type cationic surface-active agents. The amine salt type surface-active agents may include, e.g., alkylamine salts, aminoalcohol fatty acid derivatives, polyamine fatty acid derivatives, and imidazoline derivatives. The quaternary ammonium salt type cationic surface-active agents may include, e.g., alkyltrimethylammonium salts, dialkyldimethylammonium salts, alkyldimethylbenzylammonium salts, pyridinium salts, alkylisoquinolinium salts and benzethonium chloride. Of these cationic surface-active agents, they may include aliphatic primary, secondary or tertiary amines having a fluoroalkyl group, aliphatic quaternary ammonium salts such as perfluoroalkyl(6 to 10 carbon atoms) sulfonamide propyl trimethylammonium salts, benzalkonium salts, benzethonium chloride, pyridinium salts and imidazolinium salts.

Commercially available products of such cationic surface-active agents may include, e.g., SURFLON S-121 (available from Asahi Glass Co., Ltd.); FLUORAD FC-135 (available from Sumitomo 3M Limited); UNIDYNE DS-202 (available from Daikin Industries, Ltd.); MEGAFAC F-150, F-824 (available from Dainippon Ink & Chemicals, Incorporated); F top EF-132 (available from Tochem Products Co., Ltd.); and FTERGENT F-300 (available from NEOS Company Limited).

In the above step of dissolving the sparingly water-soluble inorganic dispersant, as a method of dissolving the inorganic dispersant present between the colored particles and the elastic material, it may preferably have an acid treatment step where hydrochloric acid is added to adjust the pH of the liquid dispersion to 5.0 or less. By such an acid treatment step, the inorganic dispersant such as a sparingly water-soluble inorganic salt is dissolved, and this enables fine particles of the elastic material to be made fast to all the colored particles present in the liquid dispersion. The toner can be more improved in its development stabilizing performance.

In the acid treatment step, acid treatment may be carried out with heating at a temperature of not higher than the glass transition point Ts (° C.) of the elastic material and at a temperature higher by 5.0° C. to 50.0° C. than the above Tt (° C.). This is preferable from the viewpoint of the development stabilizing performance of the toner. As long as it is carried out in the above temperature range, the elastic material can well be kept from coming off from the colored particles at the toner particle surfaces, to achieve a high coating efficiency for the surfaces of the colored particles. This brings achievement of good development stabilizing performance and anti-blocking performance of the toner. That temperature may much preferably be from 10.0° C. to 40.0° C.

In the above step of forming a liquid dispersion of the colored particles, it is preferable to make the aqueous medium contain the sparingly water-soluble inorganic dispersant. The inorganic dispersant may include as examples thereof phosphoric acid polyvalent metal salts such as tricalcium phosphate, magnesium phosphate, aluminum phosphate and zinc phosphate; carbonates such as calcium carbonate and magnesium carbonate; inorganic salts such as calcium metasilicate, calcium sulfate and barium sulfate; and calcium hydroxide, magnesium hydroxide, aluminum hydroxide, and inorganic oxides such as silica, bentonite and alumina. Any of these inorganic dispersants may preferably be used in an amount of from 0.2 part by mass to 20 parts by mass based on 100 parts by mass of the colored particles, and may be used alone or in combination of two or more types.

The colored particles may preferably have a glass transition point (Tt) at from 25.0° C. to 60.0° C. and a melting point (Tw) at from 65.0° C. to 95.0° C., and the fine particles of the elastic material may preferably have a glass transition point (Ts) at from 40.0° C. to 90.0° C., where a difference between the Tt and the Tw, Tw−Tt, is from 10.0° C. to 50.0° C. and a difference between the Tt and the Ts, Ts−Tt, is from 5.0° C. to 50.0° C.

Where the Tt, the Tw and the Ts are each in the above range, it is both achievable to keep the colored particles from fusing one another and to make the fine elastic material particles fast to the surfaces of the colored particles. Also, the toner can have better low-temperature fixing performance and anti-offset performance. The above Tt may much preferably be from 25.0° C. to 48.0° C., still much preferably from 30.0° C. to 48.0° C. and particularly preferably from 33.0° C. to 45.0° C. The Tw may much preferably be from 65.0° C. to 90.0° C., still much preferably from 70.0° C. to 90.0° C., and particularly preferably from 70.0° C. to 85.0° C. The Ts may much preferably be from 50.0° C. to 85.0° C., still much preferably from 55.0° C. to 80.0° C., and particularly preferably from 60.0° C. to 78.0° C.

As long as the value of (Tw−Tt) is in the above range, in the heating step the colored particles can be softened to an appropriate degree, the elastic material particles can extend over the whole surfaces of the colored particles and thereafter the former is made fast to the latter, and hence the fine elastic material particles can be in a more uniform content between the toner particles. Also, the fine elastic material particles can be kept from coming liberated from the toner particle surfaces. As the result, the toner having a good development stabilizing performance can be obtained. The like effect is obtainable also when the value of (Ts−Tt) is in the above range. The value of (Tw−Tt) may much preferably be from 15.0° C. to 50.0° C., and still much preferably from 25.0° C. to 45.0° C. The value of (Ts−Tt) may much preferably be from 10.0° C. to 40.0° C., and still much preferably from 15.0° C. to 35.0° C.

According to the present invention, the G'a and the G'b may preferably be in a ratio (G'a/G'b) of 50.0 or less. The toner of the present invention has the Ta of from 25.0 to 60.0. In such a toner, inasmuch as the value of (G'a/G'b) is in the above range, the value of δb is well brought out, and the toner can be much more improved in its anti-soaking performance and color ranging performance. The toner also has a high elasticity retentivity, and can be more improved in its development stabilizing performance. If on the other hand the value of (G'a/G'b) is too small, toner layers having been fixed tend to come non-uniform in surface state to tend to result in a low fixed-image color ranging performance. Considering the matter from this viewpoint, the value of (G'a/G'b) may preferably be 1.0 or more. Hence, the value of (G'a/G'b) may preferably be in the range of 50.0 or less, which may much preferably be from 1.0 to 30.0, still much preferably from 1.0 to 20.0, and particularly preferably from 1.0 to 13.0.

For the same reasons as the above, the G'b may preferably be from $1.00\times10^6$ Pa to $1.00\times10^7$ Pa, and much preferably from $1.50\times10^6$ Pa to $9.00\times10^6$ Pa.

The above toner may preferably have, in the tan δ curve, a maximal value Tc (° C.) at a temperature exceeding the Tb (° C.), a difference between the Tc and the Tb, Tc−Tb, of from 5.0° C. to 80.0° C., and a value of tan δ at the Tc, δc, of 10.00 or less. The toner of the present invention aims to improve the performance of a toner having low-temperature fixing performance, anti-soaking performance and anti-offset performance together, where, especially in an attempt to advance the low-temperature fixing performance, the toner may have low anti-soaking performance and anti-offset performance if its value of the G' to the G" is too small. Hence, the δc may preferably be 10.00 or less. Also, if the value of G' to the G" is too large, the toner may have a low color ranging performance. From this viewpoint, the δc may preferably be from 0.10 to 10.00. The δc may much preferably be from 0.20 to 5.00, still much preferably from 0.50 to 3.00, and particularly preferably from 0.50 to 2.00.

Inasmuch as the toner has, in the tan δ curve, the maximal value Tc (° C.) at a temperature exceeding the Tb (° C.) and the difference between the Tc and the Tb, Tc−Tb, of from 5.0° C. to 80.0° C., the toner can be more improved in its low-temperature fixing performance, anti-soaking performance and anti-offset performance even where it is heated to Tc or more in the fixing step. Hence, the value of (Tc−Tb) may much preferably be from 5.0° C. to 40.0° C., still much preferably from 10.0° C. to 40.0° C., and particularly preferably from 10.0° C. to 30.0° C.

The toner of the present invention may preferably have a ratio of the value of G' at the Tc, G'c, to the G'a, G'a/G'c, of from $1.00\times10^1$ to $1.00\times10^4$. Inasmuch as the value of (G'a/G'c) is in the above range when the δb is in the range of the present invention, the toner can be much more improved in its low-temperature fixing performance, anti-soaking performance and color ranging performance. Hence, the value of (G'a/G'c) may much preferably be from $1.00\times10^1$ to $1.00\times10^3$, and particularly preferably from $1.00\times10^2$ to $1.00\times10^3$.

The values of (G'a/G'b) and (Tc−Tb), the δc and the value of (G'a/G'c) may generally be controlled by managing the glass transition point (Tg), weight average molecular weight (Mw) and/or molecular weight distribution of the THF-soluble component contained in the toner, also its composition, the melting point of the wax, and/or production conditions for the toner.

The toner of the present invention may preferably have, where the storage elastic modulus (G') found by the dynamic viscoelasticity test is converted into a common logarithm ($\log_{10}$ G') and in a temperature-gradient curve where the gradient of the $\log_{10}$ G' at each temperature is set on the y-axis and the temperature at that time is set on the x-axis, a minimal value Tx (° C.) at from 25.0° C. to 60.0° C., a maximal value Ty (° C.) at from 45.0° C. to 80.0° C. and a minimal value Tz (° C.) at from 60.0° C. to 100.0° C., which Ty (° C.) is larger than the Tx (° C.) and which Tz (° C.) is larger than the Ty (° C.).

In the present invention, the temperature-gradient curve is that which may be determined in the following way. The storage elastic modulus G' (Pa) found by the dynamic viscoelasticity test is converted into a common logarithm ($\log_{10}$ G'). Further, the following calculation is made in order to determine the gradient of the $\log_{10}$ G' at each temperature. Where, using the value of the $\log_{10}$ G', the value of the common logarithm of a storage elastic modulus at the n-th temperature $T_n$(° C.) numbered from the data on the low-temperature side is represented by $\log_{10} G'_n$ and the value of the common logarithm of a storage elastic modulus at the (n−1)th temperature $T_{n-1}$ (° C.) is represented by $\log_{10} G'_{n-1}$, a gradient $R'_n$ of the $\log_{10} G'_n$ at the temperature $T_n$(° C.) is calculated according to the following expression (1), provided that a case of n=1 is excluded.

$$R'_n=(\log_{10} G'_n-\log_{10} G'_{n-1})/(T_n-T_{n-1}). \quad \text{Expression (1)}$$

Further, with respect to the gradient $R'_n$ at the temperature $T_n$(° C.), a gradient at the (n−2)th temperature $T_{n-2}$ (° C.) is represented by $R'_{n-2}$, a gradient at the (n−1)th temperature $T_{n-1}$ (° C.) is represented by $R'_{n-1}$, a gradient at the (n+1)th temperature $T_{n+1}$ (° C.) is represented by $R'_{n+1}$ and a gradient at the (n+2)th temperature $T_{n+2}$ (° C.) is represented by $R'_{n+2}$, smoothing is performed according to the following expression (2) to calculate a gradient $R_n$ at the temperature $T_n$(° C.). This gradient $R_n$ is set on the y-axis and the temperature $T_n$(° C.) is set on the x-axis, where these valued are plotted except for the values of n=1 to 3 and last two values to obtain a curve, which is termed as the temperature-gradient curve.

$$R_n=(R_{n-2}+R_{n-1}+R_n+R_{n+1}+R_{n+2})/5. \quad \text{Expression (2)}$$

That the toner has, in the temperature-gradient curve, the maximal value Ty (° C.) between the minimal value Tx (° C.) and the minimal value Tz (° C.) shows that it has, in the storage elastic modulus (G') curve, a region where the storage elastic modulus (G') curve extends upward to form a convex curve in a temperature region present between the Tx (° C.) and the Tz (° C.). Inasmuch as the toner has the region where the storage elastic modulus (G') curve extends upward to form a convex curve, the δb can be 0.60 or less, and this is preferable from the viewpoint of overall achievement of the low-temperature fixing performance, color ranging performance and development stabilizing performance of the toner. The Tx (° C.) may much preferably be from 29.0° C. to 55.0° C., and still much preferably from 30.0° C. to 50.0° C. The Ty (° C.) may much preferably be from 50.0° C. to 65.0° C. The Tz (° C.) may much preferably be from 65.0° C. to 95.0° C., and still much preferably from 70.0° C. to 90.0° C.

The Tz (° C.) and Tx (° C.) may preferably be in a difference (Tz−Tx) of from 10.0° C. to 40.0° C. The Tx (° C.) and Ty (° C.) may preferably be in a difference of from 5.0° C. to 35.0° C., and much preferably from 10.0° C. to 30.0° C. The Ty (° C.) and Tz (° C.) may preferably be in a difference (Tz−Ty) of from 5.0° C. to 35.0° C., and much preferably from 7.0° C. to 30.0° C.

The Tx (° C.), the Ty (° C.) and the Tz (° C.) may generally be controlled by managing the uniformity of the state of presence of the elastic material in the toner particles, the type, physical properties and content of the elastic material, and the glass transition point (Tg) and/or weight average molecular weight (Mw) and molecular weight distribution of the THF-soluble component contained in the toner, also its composition, the melting point of the wax, and/or production conditions for the toner.

The toner of the present invention may preferably contain from 50.0% by mass to 93.0% by mass of a tetrahydrofuran (THF)-soluble component measured by Soxhlet extraction and also contain from 5.0% by mass to 45.0% by mass of a component insoluble in THF and soluble in chloroform. The component insoluble in THF and soluble in chloroform [corresponding to the following (2)] is considered to be a component in which part of the elastic material described previously, or part of the elastic material and part of the binder resin, has or have relatively softly cross-linked by covalent bonding and the other bonding. Inasmuch as the toner contains such a component insoluble in THF and soluble in chloroform together with the commonly known component insoluble in THF, the δa, the δb and the G'a can be held in good ranges, and the effect aimed in the present invention can well be brought out.

In general, the chloroform has a larger solubility in toner constituent materials (chiefly the binder resin) than the THF. Accordingly, the toner of the present invention may preferably be made up of (1) the THF-soluble component, (2) the component insoluble in THF and soluble in chloroform and (3) a component insoluble in THF and chloroform. The toner of the present invention may preferably contain the component insoluble in THF and soluble in chloroform in an amount of from 3.0% by mass to 15.0% by mass.

Further, the component insoluble in THF and soluble in chloroform may preferably contain a polyester which is detectable by Fourier transformation nuclear magnetic resonance spectroscopy (FT-NMR). Inasmuch as the component having softly cross-linked has the polyester, the physical properties of being insoluble in THF and soluble in chloroform are well brought out, and good anti-soaking performance and color ranging performance can be brought out without any lowering of the low-temperature fixing performance, as so considered. The polyester may also preferably have an ether linkage in the backbone chain. It is considered that the backbone chain comes freely rotatable interposing the ether linkage to better achieve the above physical properties. As an FT-NMR instrument, JNM-EX400 (manufactured by JEOL Ltd.) may be used, for example. As a solvent for measurement, deuterated chloroform containing tetramethylsilane (TMS) is used as an internal standard substance.

As a specific method for measurement, the measurement may be made by $^1$H-NMR and $^{13}$C-NMR. As conditions for measurement, the measurement may be made under the following conditions.

Measurement frequency: 400 MHz
Pulse condition: 5.0 μs
Data points: 3,276
Delay time: 25 sec
Frequency range: 10,500 Hz
Integration times: 64 times
Measurement temperature: 40° C.

Sample: 20 mg of a measuring sample is added to 1 ml of deuterated chloroform ($CDCl_3$) containing 0.05% by mass of TMS, as the solvent, and these are left to stand in an environment of temperature 24.0° C. and humidity 60.0% RH for 24 hours to effect dissolution. The solution obtained is put into a sample tube of 5 mm in diameter to make measurement.

Differences in physical properties between the component insoluble in THF and soluble in chloroform [corresponding to the above (2)] and the component insoluble in THF and chloroform [corresponding to the above (3)] are considered due to how the respective cross-linked components are composed and their differences in density of cross-linking. More specifically, one having a high density of cross-linking can be the component insoluble in THF and soluble in chloroform, where the physical properties of being insoluble in THF and soluble in chloroform are brought out when it has a sufficiently low density of cross-linking and has flexibility sufficiently as containing the polyester, as so considered.

As long as the content of the THF-soluble component is in the above range, the toner can achieve both the anti-offset performance and the low-temperature fixing performance.

As long as the content of the component insoluble in THF and soluble in chloroform is in the above range, the toner can well maintain its color ranging performance and can have better properties in respect of its anti-soaking performance and anti-offset performance. Also, its value of (δb−δa) can readily be controlled to be 0.20 or more.

The THF-soluble component may much preferably be in a content of from 60.0% by mass to 90.0% by mass, and particularly preferably from 60.0% by mass to 85.0% by mass. The component insoluble in THF and soluble in chloroform may also much preferably be in a content of from 10.0% by mass to 40.0% by mass, and particularly preferably from 10.0% by mass to 35.0% by mass.

The content of the THF-soluble component and the content of the component insoluble in THF and soluble in chloroform may be controlled by managing the type(s) and/or amount(s) of the binder resin and/or cross-linking agent to be added, and/or production conditions for the toner.

The component insoluble in THF and soluble in chloroform may preferably have an acid value Av ($Av_{c1}$) of from 5.0 mgKOH/g to 50.0 mgKOH/g. This component is considered to be a component in which one formed by covalent bonding of part of the elastic material described previously, or part of the elastic material and part of the binder resin, has or have been extracted. Where this component has acid value in the above range, its acid groups can readily interact with the surfaces of colored particles, and the elastic material contained in individual particles of the toner can readily be in a uniform quantity between toner particles while limiting the amount of the elastic material to be added, held in the whole toner. Also, the values of δb and G'a can readily be controlled. The $Av_{c1}$ of the elastic material may much preferably from 5.0 mgKOH/g to 40.0 mgKOH/g, still much preferably from 5.0 mgKOH/g to 30.0 mgKOH/g, and particularly preferably from 10.0 mgKOH/g to 26.0 mgKOH/g.

The component insoluble in THF and soluble in chloroform may preferably contain a sulfur element derived from a sulfonic acid group which is detectable by fluorescent X-ray measurement. This component is considered to be a component in which one formed by covalent bonding of part of the elastic material described previously, or part of the elastic material and part of the binder resin, has been extracted. Inasmuch as this component has such a sulfur element derived from a sulfonic acid group, the elastic material contained in individual particles of the toner can readily be in a uniform quantity between toner particles while limiting the amount of the elastic material to be added, held in the whole toner.

The sulfur element derived from a sulfonic acid group may preferably be in a content of from 0.010% by mass to 1.000% by mass. If the sulfur element is in a content of less than 0.010% by mass, the effect of incorporating the sulfur element may be obtained with difficulty. If the sulfur element is in a content of more than 1.000% by mass, the toner may have a low low-temperature fixing performance because of mutual action between the sulfonic acid group and any other polar group(s). The sulfur element may much preferably be in a content of from 0.010% by mass to 0.500% by mass, and particularly preferably from 0.020% by mass to 0.300% by mass.

The content of the THF-soluble component and the content of the component insoluble in THF and soluble in chloroform are specifically defined by values measured by Soxhlet extraction shown below. The component soluble in THF, component insoluble in THF and component insoluble in THF and soluble in chloroform which are contained in the toner of the present invention also refer to components recovered in the following way.

A cylindrical filter paper (e.g., No. 86R, available from Toyo Roshi Kaisha, Ltd., may be used) is vacuum-dried at 40° C. for 24 hours, and thereafter left to stand for 3 days in an environment controlled to temperature and humidity of 25° C./60% RH. Where the true density of the toner is represented by ρ (g/cm$^3$), (1×ρ) g of the toner is weighed (W1 g), and put into this cylindrical filter paper, which is then set on a Soxhlet extractor to carry out extraction in a 90° C. oil bath for 24 hours using 200 ml of THF as a solvent. Thereafter, the Soxhlet extractor is cooled at a cooling rate of 1° C. per minute, and thereafter the cylindrical filter paper is gently taken out, and then vacuum-dried at 40° C. for 24 hours. This is left to stand for 3 days in an environment controlled to temperature and humidity of 25° C./60% RH, and thereafter the quantity of solid matter remaining in the cylindrical filter paper is weighed (W2 g). This solid matter is regarded as the THF-insoluble component contained in the toner.

The content of the THF-soluble component of the toner is calculated from the following expression.

$$\text{Content (\% by mass) of THF-soluble component of toner}=\{1-(W2/W1)\}\times 100.$$

For the THF-soluble component contained in the toner, the eluate component obtained as above is filtered with a quantitative filter paper (e.g., a quantitative filter paper No. 5A, available from Advantec MFS, Inc., may be used). As to the solution obtained, its volatile components are evaporated off by using an evaporator set at 40° C., and thereafter vacuum-dried at 40° C. for 24 hours to obtain a solid matter, which is defined to be the component soluble in THF.

For the content of the component insoluble in THF and soluble in chloroform, the cylindrical filter paper having the THF-soluble component obtained by the above Soxhlet extraction is set on a Soxhlet extractor to carry out extraction in a 90° C. oil bath for 24 hours using 200 ml of chloroform as a solvent. Thereafter, the Soxhlet extractor is cooled at a cooling rate of 1° C. per minute, and thereafter the cylindrical filter paper is gently taken out, and then vacuum-dried at 40° C. for 24 hours. This is left to stand for 3 days in an environment controlled to temperature and humidity of 25° C./60% RH, and thereafter the quantity of solid matter remaining in the cylindrical filter paper is weighed (W3 g).

The content of the component insoluble in THF and soluble in chloroform is calculated from the following expression.

$$\text{Content (\% by mass) of component insoluble in THF and soluble in chloroform of toner}=\{1-(W3/W2)\}\times 100.$$

Where compositional analysis and molecular weight measurement are made on the component insoluble in THF and soluble in chloroform, the eluate component obtained as above is filtered with a quantitative filter paper (e.g., a quantitative filter paper No. 5A, available from Advantec MFS, Inc., may be used). As to the solution obtained, its volatile components are evaporated off by using an evaporator set at 40° C., and thereafter vacuum-dried at 40° C. for 24 hours to obtain a solid matter, which is used therefor.

The true density of the toner may be measured with, e.g., a dry automatic densitometer ACCUPYC 1330 (manufactured by Shimadzu Corporation).

The THF-soluble component contained in the toner may preferably have a maximal value (Mp) at a molecular weight of from 8,000 to 200,000, in molecular weight distribution measured in terms of polystyrene (St) by gel permeation chromatography (GPC). Inasmuch as the THF-soluble component has Mp in the above range, the toner can have a good balance between its sharp melting and the retention of its viscosity at the time of melting, and can be more improved in its low-temperature fixing performance, anti-soaking performance, color ranging performance and anti-offset performance. If the Mp is less than 8,000, the toner may have low anti-offset performance and anti-soaking performance. If the Mp is more than 200,000, the toner may have low low-temperature fixing performance and anti-soaking performance. As the range of the Mp, it may much preferably be at a molecular weight of from 10,000 to 100,000, and particularly preferably a molecular weight of from 15,000 to 35,000.

For the same reasons, the THF-soluble component may preferably have a weight average molecular weight (Mw) of from 10,000 to 500,000. If its Mw is less than 10,000, the toner may have low anti-offset performance and anti-soaking performance. If its Mw is more than 500,000, the toner may have low low-temperature fixing performance and anti-soaking performance. As the range of the Mw, it may much preferably be from 30,000 to 200,000, and particularly preferably from 50,000 to 150,000.

To make the THF-soluble component have the Mp and Mw in the above ranges, it may be made by selecting the types of the binder resin and/or cross-linking agent to be added and/or controlling the amounts thereof and/or production conditions for the toner.

The toner of the present invention may preferably have an average circularity in the range of from 0.945 to 0.995, much preferably from 0.965 to 0.995, and particularly preferably from 0.975 to 0.990, as measured with FPIA-3000. As long as it has average circularity in the above range, the toner particles can be kept from breaking, and also the toner can be kept from coming to be densely packed in a toner container. The average circularity of the toner of the present invention may be controlled also by using a surface modifying apparatus described later.

The toner of the present invention may preferably have particles of 1 μm or less in diameter in a content of 20.0% by number or less in its number distribution measured with FPIA-3000. As long as the particles of 1 μm or less in diameter are in a content of 20.0% by number or less, such particles can not easily come to accumulate, and the toner can be more improved in its development stabilizing performance. The toner can also be improved in graininess in areas of low image density, and can provide good images having been kept from a feeling of coarseness. In the toner containing the elastic material as in the present invention, if the elastic material is contained in a non-uniform state at the toner particle surfaces, the elastic material tends to be detected as particles of 1 μm or less in diameter and the toner tends to have a low development stabilizing performance. Such particles may much preferably be in a content of 15.0% by number or less, still much preferably 10.0% by number or less, and particularly preferably 5.0% by number or less.

The toner of the present invention may preferably have a weight average particle diameter (D4) of from 3.0 μm to 7.0 μm. As long as it has D4 in this range, it not only can provide good images having been kept from a feeling of coarseness, but also can be kept from coming to be densely packed even during long-term storage. If on the other hand it has D4 outside the above range, the toner may provide a poor graininess in areas of low image density, and may provide images having a feeling of coarseness. As a preferable range of the D4, it may much preferably be from 3.5 μm to 6.5 μm, and particularly preferably from 4.0 μm to 6.0 μm.

The toner may preferably have, where its degree of agglomeration $A_0$ (%) at a temperature of 23.0° C. and a humidity of 60% is represented by $A_0$ (%), an $A_0$ (%) of 70.0% or less, and have, where the temperature at which the degree of agglomeration of the toner comes to $A_0$+10.0% is represented by $T_1$ (° C.) and the temperature at which the degree of agglomeration comes to 98.0% is represented by $T_2$ (° C.), a difference between the $T_1$ (° C.) and the above Ta (° C.) measured by a dynamic viscoelasticity test, $T_1$−Ta (° C.), of from 2.0° C. to 40.0° C., and also have a rate of change in the degree of agglomeration at the $T_1$ (° C.) and at the $T_2$ (° C.), $\alpha=\{98.0-(A_0+10.0)\}/(T_2-T_1)$, of from 15.0 to 50.0.

The above physical properties are considered to be indexes showing the distribution of thermal properties of individual particles of the toner. In the case of a toner containing two or more kinds of materials having different thermal properties, these are also considered to be indexes showing any scattering of the content, or the state of presence, of each material the individual particles of the toner contain. Further, in the toner having i) the toner particles having the colored particles containing at least a binder resin, a colorant and a wax and the elastic material with which the colored particles stand coated and ii) an inorganic fine powder, they are considered to be indexes showing the uniformity of the state of coating with the elastic material on the surfaces of the colored particles and the uniformity of the content of the elastic material between the toner particles. More specifically, it is considered that, where the toner has physical properties in the above ranges, the content of the elastic material over the whole toner stands small and also the content, and the state of presence, of the elastic material are uniform between the individual particles of the toner. In such a case, the δb can readily be especially small value, which is particularly preferable from the viewpoint of overall achievement of the low-temperature fixing performance, anti-offset performance, anti-blocking performance, development stabilizing performance, anti-soaking performance and color ranging performance of the toner.

How to measure the degree of agglomeration is shown below.

Where the true density of the toner is represented by ρ (g/cm$^3$), (2.0×ρ) g of the toner is weighed, and put into a plastic container of 50 ml in capacity (a cylindrical container made of polyethylene may be used which is of 76 mm in height, 1,134 mm$^2$ in bottom area and 38 mm in outer diameter, e.g., a 50 ml wide-mouthed plastic bottle available from Sanplatec Co., Ltd.). At this point, the toner layer is so made as to be substantially level in the plastic container. This is called a "toner in plastic container".

Hot-air circulation type thermostat controllers are readied the temperatures of which have been changed in temperature at intervals of 10.0° C. in respect of the range of temperatures of from 25.0° C. to 95.0° C. (e.g., Compact Precision Thermostat Controller "AWC-2", manufactured by Asahirika Seisakusho Co., Ltd., may be used). The toner in plastic container is put into each thermostat controller the atmospheric temperature in which has been controlled, and left to stand therein. After 72 hours, the plastic container is gently taken out of each thermostat controller so as not to apply any vibration, and left to stand in an environment of temperature 23.0° C. and humidity 60% RH for 24 hours. Next, an iron plate of about 1 cm thick (30 cm in length×30 cm in width) is placed on the floor, where the plastic container is naturally dropped thereon in the state it is kept vertical at a position of 1 m in height. The plastic container having been dropped is again left to stand in the environment of temperature 23.0° C. and humidity 60% RH for 24 hours. Using the toner treated in this way, the degree of agglomeration a (%) at each temperature is determined by the method described later.

Besides the foregoing, a toner in plastic container is also readied the temperature of which is not changed, and this is left to stand in an environment of temperature 23.0° C. and humidity 60% RH. After 72 hours, the plastic container is gently taken out of each thermostat controller in the same way as the above, and left to stand in an environment of temperature 23.0° C. and humidity 60% RH for 24 hours. Next, an iron plate of about 1 cm thick is placed on the floor, where the plastic container is naturally dropped thereon in the state it is kept vertical at a position of 1 m in height. The plastic container having been dropped is again left to stand in the environment of temperature 23.0° C. and humidity 60% RH for 24 hours. Using this toner, the degree of agglomeration $A_0$ (%) in the environment of temperature 23.0° C. and humidity 60% RH is determined by the method described later.

Rates of change between the degree of agglomeration a (%) at each temperature and the degree of agglomeration $A_0$ (%) in the environment of temperature 23.0° C. and humidity 60% RH which have been thus measured [rate of change=$(a-A_0)\times 100/A_0$] are compared to determine the lowest temperature t (° C.) at which the rate of change comes to be 10.0% or more.

In order to determine further detailed data of the rate of change from the results obtained, thermostat controllers are readied the atmospheric temperatures in which have been changed at intervals of 20.0° C. in respect of the range of temperatures of from i) temperature (° C.) which is lower than the temperature (° C.) of [temperature t (° C.)-10.0(° C.)] and is highest when measured at intervals of 10.0° C. in respect of the range of temperatures of from 25.0° C. to 95.0° C. to ii) 95.0° C., and then the toner in plastic container is put into each thermostat controller and left to stand therein. Subsequently, likewise, after 72 hours, the plastic container is gently taken out of each thermostat controller, and left to stand in an environment of temperature 23.0° C. and humidity 60% RH for 24 hours. Next, likewise, the plastic container is naturally dropped in the state it is kept vertical at a position of 1 m in height. This plastic container is again left to stand in the environment of temperature 23.0° C. and humidity 60% RH for 24 hours. Using this toner, the degree of agglomeration A (%) at each temperature T (° C.) is determined by the method described later.

From the values thus obtained, a graph of [T (° C.)–A (%)] is prepared in which the temperature T (° C.) of each thermostat controller in which the toner in plastic container has been left to stand for 72 hours is plotted as the x-axis and the degree of agglomeration A (%) at that point of time as the y-axis. Each value is read from this graph.

More specifically, a point of $(A_0+10.0)$% is found on the y-axis of the graph, and the value on the x-axis, corresponding thereto, is represented by $T_1$ (° C.), then a point of 98.0% is found on the y-axis of the graph, and the value on the x-axis, corresponding thereto, is represented by $T_2$ (° C.).

As a measuring instrument for the degree of agglomeration, e.g., an instrument is used in which "POWDER TESTER" (manufactured by Hosokawa Micron Corporation) to which a digital display type vibroscope "DEGIVIBRO MODEL 1332A" (manufactured by Showasokki Co., Ltd.) has been connected at the former's side portion of a vibrating stand. A sieve of 38 μm in opening (400 meshes), a sieve of 75 μm in opening (200 meshes) and a sieve of 150 μm in opening (100 meshes) are superposed in this order from the bottom, and these are set on the vibrating stand of the above instrument. Measured in an environment of temperature 23.0° C. and humidity 60% RH and in the following way.

(1) The vibratory width of the vibrating stand is beforehand so adjusted that the value of displacement of the digital display type vibroscope may be 0.60 mm (peak-to-peak).

(2) The toners temperature-controlled in the manner as described above are each gently placed on the sieve of 150 μm in opening at the uppermost stage, and the mass of the toner is measured.

(3) The vibrating stand is vibrated for 90 seconds, and thereafter the mass of the toner having remained on each sieve is measured. The degree of agglomeration A (%) is calculated according to the following expression.

$$\text{Degree of agglomeration } A\ (\%)=\{(\text{mass (g) of sample on sieve of 150 μm opening})/5\ (\text{g})\}\times 100+\{(\text{mass (g) of sample on sieve of 75 μm opening})/5\ (\text{g})\}\times 100\times 0.6+\{(\text{mass (g) of sample on sieve of 38 μm opening})/5\ (\text{g})\}\times 100\times 0.2$$

The Ta (° C.) measured by a dynamic viscoelasticity test is considered to be a value corresponding to the glass transition point (Tg) of the colored particles the toner has, and the $T_1$ (° C.) and $T_2$ (° C.) are values corresponding to the Tg of the elastic material and the state of presence, and the content, of the elastic material in the toner particles. For example, in the case of a toner which has colored particles having a low Tg (° C.) and an elastic material with which the colored particles stand coated and having a high Tg (° C.), and in the case of a toner in which colored particles are coated with the elastic material in a sufficiently large quantity for the colored particles, the $T_1$ (° C.) measured in the manner described above tends to be a value close to the Tg (° C.) of the elastic material. Since the toner contains the elastic material in a large quantity, the $T_2$ (° C.) tends to be a high value and the α tends to be a small value. In this case, the δb tends to be a small value, but the G' a tends to be a large value, where the toner tends to have low low-temperature fixing performance and color ranging performance.

If on the other hand the elastic material is in a small content for the colored particles, the state the colored particles are coated with the elastic material tends to come non-uniform. More specifically, a state tends to come in which areas where the colored particles stand bare and areas where the colored particles are coated with the elastic material are mixedly present on the surfaces of toner particles. In this case, the $T_1$ (° C.) tends to be a value close to the Tg (° C.) of the colored particles. However, the $T_2$ (° C.) is influenced by the Tg (° C.) of the elastic material to show a somewhat high value, and hence the α is a small value. In this case, the δb tends to be a large value, where the toner tends to have low anti-soaking performance, color ranging performance and anti-offset performance.

Further, where the state of coating at the toner particle surfaces is compared about individual particles of the toner, there may be a case in which areas where the colored particles do not stand bare at all to the toner particle surfaces, areas where some colored particles stand bare thereto and areas where the colored particles are not coated at all with the elastic material are mixedly present. In such a case, the $T_1$ (° C.) tends to be a smaller value, the $T_2$ (° C.) tends to be a larger value and the α tends to be a smaller value. In this case, too, the δb tends to be a large value, where the toner tends to have low anti-soaking performance and development stabilizing performance.

Accordingly, it is preferable that the coat layers of the elastic material with which the colored particles are coated are small in thickness at a certain level and such coat layers of the elastic material are uniform in thickness over the whole toner particle surfaces. Further, it is preferable that such uniformity of the state the colored particles are coated with the elastic material extends over the whole toner even in comparison about individual particles of the toner. In such a case, inasmuch as the coat layers of the elastic material are small in thickness at a certain level, the $T_2$ (° C.) tends to be a small value, but the $T_1$ (° C.) does not tend to be a small value. Further, inasmuch as the coat layers formed of the elastic material are uniform in thickness over the whole toner particle surfaces and such uniformity of the state of coating with the elastic material extends over the whole toner even in comparison about individual particles of the toner, the $T_2$ (° C.) tends to be a small value, but the $T_1$ (° C.) can be kept from being a small value. Hence, the α can readily be a large value and, in such a case, the G'a and the δb can readily be in good ranges, and the toner can especially improved in its low-temperature fixing performance, anti-blocking performance, development stabilizing performance, anti-soaking performance and color ranging performance.

The toner of the present invention may preferably have the value of ($T_1$−Ta) in the range of from 2.0° C. to 40.0° C. This is preferable in view of overall achievement of the low-temperature fixing performance, anti-blocking performance, anti-soaking performance and color ranging performance of the toner. As long as the value of ($T_1$−Ta) is in the above range, the elastic material can also well be kept from coming off the surfaces of colored particles, and the coat layers can be in an appropriate thickness. The value of ($T_1$−Ta) may preferably be in the range of temperature of from 5.0° C. to 35.0° C., and much preferably from 8.0° C. to 30.0° C.

The $T_1$ (° C.) may also be from 40.0° C. to 80.0° C. This is preferable in view of overall achievement of the low-temperature fixing performance, development stabilizing performance, anti-soaking performance and color ranging performance of the toner.

Where the $T_1$ (° C.) is in the above range, the toner can be more improved in its anti-soaking performance and color ranging performance. The $T_1$ (° C.) may much preferably be in the range of from 45.0° C. to 70.0° C., and particularly preferably from 50.0° C. to 70.0° C.

The $T_1$ (° C.) may be controlled by managing the state of coating, and/or the level of coating, of the elastic material at the toner particle surfaces. Hence, it may be controlled by managing the amount, composition, molecular weight and/or acid value of the elastic material to be added, the type and amount of the other functional group the elastic material may have, and/or production steps in which the colored particles are coated with the elastic material. It is also influenced by thermal properties of the colored particles, and hence it may also be controlled by managing the composition and/or molecular weight of the binder resin, the type, molecular weight and/or amount of the wax to be added, and/or the other additive(s).

The toner of the present invention may also have a rate α of change in the degree of agglomeration, of from 15.0 to 50.0. This is preferable in view of overall achievement of the low-temperature fixing performance, development stabilizing performance, color ranging performance and anti-soaking performance of the toner. It shows that, the larger the α is, the larger change in the degree of agglomeration the tone has for any slight changes in temperature environment. Where the rate of change α is in the above range, the state the colored particles are coated with the elastic material can be uniform and the colored particles have appropriate coat layers, as so considered. The rate of change α may preferably be from 16.0 to 45.0, and much preferably from 18.0 to 42.0. Further, the rate of change α may particularly preferably from 17.0 to 40.0.

The rate of change α is greatly influenced by the state of coating with the elastic material at the toner particle surfaces and the level of coating. Hence, it may be controlled by managing the amount, composition, molecular weight and/or acid value of the elastic material to be added, the type and/or amount of the other functional group the elastic material may have, and/or production steps in which the colored particles are coated with the elastic material. It is also influenced by thermal properties of the colored particles, and hence it may also be controlled by managing the composition and/or molecular weight of the binder resin, the type, molecular weight and/or amount of the wax to be added, and/or the other additive(s).

The degree of agglomeration $A_0$ (%) may preferably be 70.0% or less. The toner having an $A_0$ (%) of 70.0% or less is preferable in view of its development stabilizing performance. If the toner has an $A_0$ (%) of more than 70.0%, it tends to undergo convection over a toner carrying member and a charging member, and the toner may have a low development stabilizing performance. This is because the toner tends to receive so large stress in a developer container that the toner particles tend to deform, as so considered. The $A_0$ (%) may preferably be in the range of 30.0% or less, and much preferably 15.0% or less.

If on the other hand the $A_0$ (%) is too small, the toner tends to enter fibers of paper, and the toner may have a low color ranging performance. Also, where the toner contains an additive such as inorganic or resin fine particles in a large quantity in order to make the toner have a small value of $A_0$ (%), the toner tends to have a low low-temperature fixing performance. Further, such an additive tends to accumulate on a toner carrying member and a charging member to tend to make the toner have a low development stabilizing performance. From these viewpoints, the $A_0$ (%) may preferably be 0.3% or more and much preferably 1.0% or more. Thus, the $A_0$ (%) may preferably be from 0.3% to 70.0%, and much preferably from 1.0% to 30.0%. Further, the $A_0$ (%) may particularly preferably be from 1.0% to 15.0%.

The $A_0$ (%) may be controlled by managing the composition, particle diameter and/or amount of the inorganic dispersant to be added. It may also be controlled by managing the state the colored particles are coated with the elastic material.

Materials usable in the toner of the present invention and how to produce them are described next.

As the binder resin usable in the toner of the present invention, various kinds of resin may be used which are conventionally known as binder resins used for electrophotography. In particular, it may preferably have as a chief component a resin selected from (a) a polyester, (b) a hybrid resin having a polyester and a vinyl polymer, (c) a vinyl polymer, and a mixture of any of these. The polyester may preferably have a urethane linkage or a urea linkage.

As monomers usable in the binder resin in the present invention, stated specifically, any of the following compounds may be used.

As a dihydric alcohol component, it may include bisphenol-A alkylene oxide addition products such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane and polyoxypropylene(6)-2,2-bis(4-hydroxyphenyl)propane; and ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, a bisphenol derivative represented by the following formula (VII):

(VII)

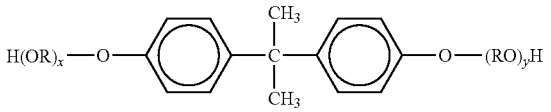

wherein R represents an ethanediyl group or a propylene-1, 2-diyl group, x and y each represent an integer of 1 or more, and the average value of x+y represents 2 to 10, and a compound represented by the following formula (VIII):

(VIII)

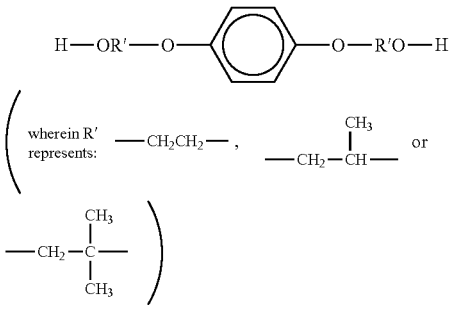

As a trihydric or higher alcohol component, it may include, e.g., sorbitol, 1,2,3,6-hexanetetrol, 6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

As a polybasic carboxylic acid monomer component, it may include aromatic dicarboxylic acids such as phthalic acid, isophthalic acid and terephthalic acid, or anhydrides thereof; alkyldicarboxylic acids such as succinic acid, adipic acid, sebacic acid and azelaic acid, or anhydrides thereof; succinic acids substituted with an alkyl group having 6 to 12 carbon atoms, or anhydrides thereof; unsaturated dicarboxylic acids such as fumaric acid, maleic acid and citraconic acid, or anhydrides thereof; and n-dodecenylsuccinic acid, isododecenylsuccinic acid and trimellitic acid.

Of these, a polyester obtained by condensation polymerization of i) the bisphenol derivative represented by the above formula (VIII), ii) as a diol component an alkyl diol having 2 to 6 carbon atoms and iii) as an acid component a carboxylic acid component composed of a dibasic carboxylic acid or an acid anhydride thereof or a lower alkyl ester thereof (e.g., fumaric acid, maleic acid, phthalic acid, terephthalic acid, trimellitic acid, pyromellitic acid, an alkyldicarboxylic acid having 4 to 10 carbon atoms, and an anhydride of any of these compounds) is preferable as having good charge characteristics for the toner.

As a tribasic or higher carboxylic acid component for forming a polyester resin having cross-linked moieties, it may include, e.g., 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid, and anhydrides or ester compounds of these.

The tribasic or higher, polycarboxylic acid component may be used in an amount of from 0.1 mol % to 1.9 mol % based on the whole monomers. Further, a hybrid resin having an ester linkage in the backbone chain and having a polyester unit that is a polycondensation product of a polyhydric alcohol with a polybasic acid and a vinyl polymer unit that is a polymer having an unsaturated hydrocarbon group may be used as the binder resin, where the toner can be of much better wax dispersibility and expected to be improved in its low-temperature fixing performance and anti-offset performance.

The hybrid resin used in the present invention means a resin in which a vinyl polymer unit and a polyester unit have chemically combined. Stated specifically, it is a resin formed by ester interchange reaction of a polyester unit with a vinyl polymer unit made up by polymerizing a monomer having a carboxylate group such as an acrylate or methacrylate, and may preferably be a graft copolymer (or a block copolymer) composed of the vinyl polymer unit as the backbone polymer and the polyester unit as the branch polymer.

As the vinyl monomer for forming the vinyl polymer unit, it may include, e.g., styrene; styrene derivatives such as o-methylstyrene, m-methylstyrene, p-methylstyrene, α-methylstyrene, p-phenylstyrene, ethylstyrene, 2,4-dimethylstyrene, p-n-butylstyrene, p-tert-butylstyrene, p-n-hexylstyelene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene; styrene unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide.

It may further include monomers having carboxyl groups, as exemplified by unsaturated dibasic acids such as maleic acid, citraconic acid, itaconic acid, alkenylsuccinic acids, fumaric acid and mesaconic acid; unsaturated dibasic acid anhydrides such as maleic anhydride, citraconic anhydride, itaconic anhydride and alkenylsuccinic anhydrides; half esters of unsaturated dibasic acids, such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half esters, methyl fumarate half ester, and methyl mesaconate half ester; unsaturated dibasic esters such as dimethyl maleate and dimethyl fumarate; α,β-unsaturated acids such as acrylic acid, methacrylic acid, crotonic acid and cinnamic acid; α,β-unsaturated acid anhydrides such as crotonic anhydride and cinnamic anhydride; anhydrides of the α,β-unsaturated acids with lower fatty acids; and alkenylmalonic acids, alkenylglutaric acids, alkenyladipic acids, acid anhydrides of these and monoesters of these.

It may still further include monomers having hydroxyl groups, as exemplified by acrylates or methacrylates such as 2-hydroxyethyl acrylate, 2-hydroxyethyl methacrylate and 2-hydroxypropyl methacrylate; and 4-(1-hydroxy-1-methylbutyl)styrene and 4-(1-hydroxy-1-methylhexyl)styrene.

In the toner of the present invention, the vinyl polymer unit in the binder resin may have a cross-linked structure, cross-linked with a cross-linking agent having at least two vinyl groups. The cross-linking agent used in such a case may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moieties have each been replaced with methacrylate; diacrylate compounds linked with an alkyl chain containing an ether linkage, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moieties have each been replaced with methacrylate; diacrylate compounds linked with a chain containing an aromatic group and an ether linkage, as exemplified by polyoxyethylene(2)-2,2-bis(4-hydroxyphenyl)propane diacrylate, polyoxyethylene(4)-2,2-bis(4-hydroxyphenyl)propane diacrylate, and the above compounds whose acrylate moieties have each been replaced with methacrylate.

As a polyfunctional cross-linking agent, it may include pentaerythritol triacrylate, trimethylolethane triacrylate, trimethylolpropane triacrylate, tetramethylolmethane tetraacrylate, oligoester acrylate, and the above compounds whose acrylate moieties have each been replaced with methacrylate; triallylcyanurate, and triallyltrimellitate.

In the hybrid resin used in the present invention, it is preferable that any one or both of the vinyl polymer unit and the polyester unit is/are incorporated with a monomer component capable of reacting with both the resin components. Among monomers constituting the polyester unit, a monomer capable of reacting with the vinyl polymer unit may include, e.g., unsaturated dicarboxylic acids such as fumaric acid, maleic acid, citraconic acid and itaconic acid, or anhydrides thereof. Among monomers constituting the vinyl polymer unit, a monomer capable of reacting with the polyester unit may include monomers having a carboxyl group or a hydroxyl group, and acrylates or methacrylates.

As a method for obtaining the reaction product of the vinyl polymer unit with the polyester unit, a method is preferred in which, in the state a polymer which contains monomer components capable of reacting with the respective units are present, polymerization reaction for any one or both of the resins is carried out to obtain it.

As a polymerization initiator used when the vinyl polymer unit in the present invention is produced, it may include, e.g., 2,2'-azobisisobutyronitrile, 2,2'-azobis-(4-methoxy-2,4-dimethylvaleronitrile), 2,2'-azobis-(2,4-dimethylvaleronitrile), 2,2'-azobis-(2-methylbutyronitrile), dimethyl-2,2'-azobisisobutyrate, 1,1'-azobis-(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile and 2,2'-azobis-(2-methyl-propane); ketone peroxides such as methyl ethyl ketone peroxide, acetylacetone peroxide and cylcohexanone peroxide; and 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, di-cumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, di-isopropyl peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate, di(3-methyl-3-methoxybutyl) peroxydicarbonate, acetylcylohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydrophthalate and di-t-butyl peroxyacetate.

As methods by which the hybrid resin can be produced may include, e.g., production methods shown in the following (1) to (5).

(1) A method of separately producing a vinyl polymer and a polyester resin, and thereafter dissolving and swelling them in a small amount of an organic solvent, followed by addition of an esterifying catalyst and an alcohol and then heating to effect ester interchange reaction.

(2) A method of first producing a vinyl polymer and thereafter producing a polyester unit and a hybrid resin component in the presence of the vinyl polymer. The hybrid resin component is produced by allowing the vinyl polymer unit (a vinyl monomer may optionally be added) to react with any one of a polyester monomer (such as an alcohol or a carboxylic acid) and a polyester or allowing the both to react with each other. In this case, too, an organic solvent may appropriately be used.

(3) A method of first producing a polyester resin and thereafter producing a vinyl polymer and a hybrid resin component in the presence of the polyester resin. The hybrid resin component is produced by allowing the polyester unit (a polyester monomer may optionally be added) to react with any one or the both of a vinyl monomer and a vinyl polymer.

(4) A vinyl polymer unit and a polyester unit are first produced and thereafter any one or both of a vinyl monomer and a polyester monomer (such as an alcohol or a carboxylic acid) is/are added in the presence of these polymer units. In this case, too, an organic solvent may appropriately be used.

(5) A vinyl monomer and a polyester monomer (such as an alcohol or a carboxylic acid) are mixed to effect addition polymerization and condensation polymerization reactions continuously to produce a vinyl polymer unit, a polyester unit and a hybrid resin component. In this case, too, an organic solvent may appropriately be used.

In the above production methods (1) to (5), a plurality of polymer units having different molecular weights and different degrees of cross-linking may be used as the vinyl polymer unit and the polyester unit.

Besides, a hybrid resin component may first be produced and thereafter any one or both of a vinyl monomer and a polyester monomer (such as an alcohol or a carboxylic acid) may be added to effect at least one of addition polymerization and condensation polymerization reactions to further produce a vinyl polymer unit and a polyester unit. In this case, too, an organic solvent may appropriately be used.

The binder resin to be contained in the toner of the present invention may make use of a mixture of the polyester resin and a vinyl polymer, a mixture of the hybrid resin and a vinyl polymer, and a mixture of the polyester resin, the hybrid resin and in addition thereto a vinyl polymer.

The toner of preferably contains one or two or more kinds of wax. The wax usable in the present invention may include, e.g., aliphatic hydrocarbon waxes such as low-molecular weight polyethylene, low-molecular weight polypropylene, olefinic copolymers, microcrystalline wax, paraffin wax and Fischer-Tropsch wax; oxides of aliphatic hydrocarbon waxes, such as polyethylene oxide wax; block copolymers of the aliphatic hydrocarbon waxes; waxes composed chiefly of a fatty ester, such as carnauba wax and montanate wax; and those obtained by subjecting part or the whole of fatty esters to deoxidizing treatment, such as dioxidized carnauba wax. For example, ester wax may include behenyl behenate and stearyl stearate.

Then, it may include partial ester compounds of fatty acids such as behenic monoglyceride with polyhydric alcohols, and methyl ester compounds having a hydroxyl group, obtained by hydrogenating vegetable fats and oils.

The wax may preferably have, in its molecular weight distribution, a main peak in the region of molecular weight of from 350 to 2,400, and much preferably in the region of molecular weight of from 400 to 2,000. Making the wax have such molecular weight distribution can provide the toner with preferable thermal properties.

As the content of the wax, it may also preferably be in a content of from 3 parts by mass to 30 parts by mass based on 100 parts by mass of the binder resin. In the toner of the present invention, part of the wax contained in the toner is made to melt together with the binder resin when the toner is produced, so as to be used as a plasticizer. Further, in the fixing step, part of the wax contained in the toner is made to melt together with the binder resin so as to be used as a plasticizer. Hence, since it is not that all the wax incorporated in the toner acts as a release agent, it is preferable for the wax to be incorporated in a larger quantity than usual. As long as the wax is in a content in the above range, the toner can well achieve both the low-temperature fixing performance and the anti-offset performance. The wax may much preferably be in a content based on 100 parts by mass of the binder resin, of from 5 parts by mass to 20 parts by mass, and particularly preferably from 6 parts by mass to 14 parts by mass.

Where it is necessary to extract the wax from the toner in determining such physical properties as above, there are no particular limitations on extraction methods, and any methods may be used.

To give an example, the toner in a stated quantity is subjected to Soxhlet extraction with toluene. The solvent is removed from toluene-soluble matter, and thereafter chloroform-insoluble matter is obtained. Thereafter, analysis for identification is made by an IR method or the like.

In regard to quantitative determination, quantitative analysis is made by DSC.

As the wax, a wax is preferred which has, in a DSC curve obtained by measurement with a differential scanning calorimeter, a maximum endothermic peak in the region of from 60° C. to 140° C., and much preferred is one having a maximum endothermic peak in the region of from 60° C. to 90° C. Inasmuch as it has a maximum endothermic peak in the above temperature region, it can greatly contribute to low-temperature fixing and at the same time can also effectively bring out its release properties. Further, where the toner is directly obtained by a polymerization process in which polymerization is carried out in an aqueous medium, the wax can be kept from precipitating during granulation even when the wax is added in a large quantity.

The toner of the present invention may make use of a charge control agent.

As a charge control agent capable of controlling the toner to be negatively chargeable, it may include, e.g., organometallic compounds, chelate compounds, monoazo metal compounds, acetylacetone metal compounds, urea derivatives, metal-containing salicylic acid compounds, metal-containing naphthoic acid compounds, quaternary ammonium salts, calixarene, silicon compounds, and non-metal carboxylic compounds and derivatives thereof.

As a charge control agent capable of controlling the toner to be positively chargeable, it may include, e.g., Nigrosine and its products modified with a fatty acid metal salt; quaternary ammonium salts such as tributylbenzylammonium 1-hydroxy-4-naphthosulfonate and tetrabutylammonium teterafluoroborate, and analogues of these, including onium salts such as phosphonium salts, and lake pigments of these; triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate. Any of these may be used alone or in combination of two or more types. Of these, charge control agents such as Nigrosine and quaternary ammonium salts may particularly preferably be used.

The charge control agent may preferably be so contained in the toner as to be in an amount of from 0.01 part by mass to 20 parts by mass, and much preferably from 0.5 part by mass to 10 parts by mass, based on 100 parts by mass of the binder resin in the toner.

The toner of the present invention contains a colorant. As black colorants, usable are carbon black, magnetic materials, and colorants toned in black by using yellow, magenta and cyan colorants shown below.

As colorants for a cyan toner, a magenta toner and a yellow toner, colorants may be used which are as shown below.

As yellow colorants, compounds typified by monoazo compounds, disazo compounds, condensation azo compounds, isoindolinone compounds, anthraquinone compounds, azo metal complex methine compounds and allylamide compounds are used, which are of pigment type. Stated specifically, the following pigments may preferably be used.

C.I. Pigment Yellow 3, 7, 10, 12 to 15, 17, 23, 24, 60, 62, 74, 75, 83, 93 to 95, 99, 100, 101, 104, 108 to 111, 117, 123, 128, 129, 138, 139, 147, 148, 150, 151, 154, 155, 166, 168 to 177, 179, 180, 181, 183, 185, 191:1, 191, 192, 193, 199 and 214.

As dye types, the yellow colorant may include, e.g., C.I. Solvent Yellow 33, 56, 79, 82, 93, 112, 162 and 163; and C.I. Disperse Yellow 42, 64, 201 and 211.

As magenta colorants, monoazo compounds, condensation azo compounds, diketopyrrolopyrrole compounds, anthraquinone compounds, quinacridone compounds, basic dye lake compounds, naphthol compounds, benzimidazolone compounds, thioindigo compounds and perylene compounds are used. Stated specifically, they may include the following colorants.

They may be exemplified by C.I. Pigment Red 2, 3, 5 to 7, 23, 48:2, 48:3, 48:4, 57:1, 81:1, 122, 146, 150, 166, 169, 177, 184, 185, 202, 206, 220, 221, 238, 254 and 269, and C.I. Pigment Violet 19 are particularly preferred.

As cyan colorants, copper phthalocyanine compounds and derivatives thereof, anthraquinone compounds and basic dye lake compounds may be used. Stated specifically, they may include C.I. Pigment Blue 1, 7, 15:1, 15:2, 15:3, 15:4, 60, 62 and 66.

Any of these colorants may be used alone, in the form of a mixture, or further in the state of a solid solution. The colorants in the present invention are selected taking account of hue angle, chroma, brightness, weatherability, transparency on OHP sheets and dispersibility in toner particles. The colorant is used by so adding it as to be in an amount of from 0.4 part by mass to 20 parts by mass based on 100 parts by mass of the binder resin.

The toner of the present invention may further be incorporated with a magnetic material so as to be used as a magnetic toner. In this case, the magnetic material may also serve as a colorant. In the present invention, the magnetic material may include iron oxides such as magnetite, hematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

These magnetic materials may preferably be those having a number average particle diameter of 5 μm or less, and preferably approximately from 0.1 μm to 0.5 μm. As amount in which the magnetic material is incorporated in the toner, it may preferably be so incorporated as to be in an amount of from 20 parts by mass to 200 parts by mass, and particularly preferably from 40 parts by mass to 150 parts by mass, based on 100 parts by mass of the binder resin.

The magnetic material may preferably be a magnetic material having a coercive force (Hc) of from 1.59 kA/m to 23.9 kA/m (20 to 300 oersteds), a saturation magnetization (σs) of from 50 $Am^2/kg$ to 200 $Am^2/kg$ and a residual magnetization (σr) of from 2 $Am^2/kg$ to 20 $Am^2/kg$ as magnetic properties under application of 796 kA/m (10 kilooersteds).

In the toner of the present invention, an inorganic fine powder or a hydrophobic inorganic fine powder may preferably be mixed as a fluidity improver by its external addition to the toner particles (toner base particles). For example, it is preferable to use fine titanium oxide powder, fine silica powder or fine alumina powder by its external addition. It is particularly preferable to use fine silica powder.

The inorganic fine powder used in the present invention may preferably be one having a specific surface area of 30 $m^2/g$ or more, and particularly from 50 $m^2/g$ to 400 $m^2/g$, as measured by the BET method utilizing nitrogen absorption, because it can give good results.

The toner of the present invention may optionally further have an external additive other than the fluidity improver in the state it is mixed in toner particles.

For example, in order to, e.g., improve cleaning performance, preferred are fine particles having a primary particle diameter of more than 30 nm (and preferably having a specific surface area of less than 50 $m^2/g$), and much preferably inorganic fine particles, or organic fine particles, having a primary particle diameter of 50 nm or more (and preferably having a specific surface area of less than 30 $m^2/g$) and being closely spherical. This is also one of preferred embodiments. For example, it is preferable to use spherical silica particles, spherical polymethyl silsesquioxane particles or spherical resin particles.

Other additives may further be used, as exemplified by lubricant powders such as fluorine resin powder, zinc stearate powder and polyvinylidene fluoride powder; abrasives such as cerium oxide powder, silicon carbide powder and strontium titanate powder; anti-caking agents; or conductivity-providing agents, e.g., carbon black powder, zinc oxide powder and tin oxide powder. Reverse-polarity organic particles and inorganic fine powder may also be added as developability improvers in a small quantity. These additives may also be used after hydrophobic treatment of their particle surfaces.

The external additives as described above may each be used in an amount of from 0.1 part by mass to 5 parts by mass or less, and preferably from 0.1 part by mass to 3 parts by mass, based on 100 parts by mass of the toner particles.

How to produce the toner of the present invention is described next. There are no particular limitations thereon as long as it is a method by which the toner satisfying the physical properties specified in the present invention can be produced, and any known method may be used.

For example, components necessary as the toner, such as the binder resin and the wax, and other additives, are thoroughly mixed in a mixer such as Henschel mixer or a ball mill, thereafter the mixture obtained is melt-kneaded by means of a heat kneading machine such as a heat roll, a kneader or an extruder to make resins melt one another. In the kneaded product obtained, other toner materials are dispersed or dissolved, followed by cooling to solidify, then pulverization, and thereafter classification. The particles obtained may further optionally be surface-treated with resin particles. Such multi-stage process is carried out to obtain toner base particles (toner base particles). To the toner particles obtained, the fine powder or the like may optionally be externally added to obtain the toner. Either of the classification and the surface treatment may be first in order. In the step of classification, a multi-division classifier may preferably be used in view of production efficiency.

The pulverization step may be carried out by using a known pulverizer such as a mechanical impact type or a jet type. In order to obtain the toner having the specific circularity according to the present invention, it is preferable to further apply heat to effect pulverization or to carry out treatment of adding mechanical impact auxiliarily. Also usable are a hot-water bath method in which toner particles finely pulverized (and optionally classified) are dispersed in hot water, a method in which the toner particles are passed through hot-air streams, and so forth.

As means for applying mechanical impact force, available are, e.g., a method making use of a mechanical impact type pulverizer such as Kryptron system, manufactured by Kawasaki Heavy Industries, Ltd., or Turbo mill, manufactured by Turbo Kogyo Co., Ltd. A method may also be used in which toner particles are pressed against the inner wall of a casing by centrifugal force by means of a high-speed rotating blade to impart mechanical impact force to the toner particles by the force such as compression force or frictional force, as in apparatus such as a mechanofusion system manufactured by Hosokawa Micron Corporation or a hybridization system manufactured by Nara Machinery Co., Ltd.

In the case when the mechanical impact is applied to carry out the treatment, the atmospheric temperature at the time of treatment may be set at a temperature around glass transition temperature Tg of the toner (i.e., a temperature in the range of ±30° C. for the glass transition temperature Tg). This is preferable from the viewpoint of prevention of agglomeration and productivity. More preferably, the treatment may be carried out at a temperature in the range of ±20° C. for the glass transition temperature Tg of the toner. This is especially effective in improving its transfer efficiency.

Further, the toner of the present invention may also be produced by a method in which a molten mixture is atomized in the air by means of a disk or a multiple fluid nozzle to obtain spherical toner particles; a dispersion polymerization method in which toner particles are directly produced using an aqueous organic solvent capable of dissolving polymerizable monomers and not capable of dissolving the resulting polymer; an emulsion polymerization method as typified by soap-free polymerization in which toner particles are produced by direct polymerization in the presence of a water-soluble polar polymerization initiator; a dissolution suspension method; or an emulsion agglomeration method.

As a particularly preferable method, a suspension polymerization method is available in which polymerizable monomers are directly polymerized in an aqueous medium.

In producing the toner by the suspension polymerization, it is common that polymerizable monomers, a colorant, a wax, a charge control agent, a cross-linking agent and so forth are dissolved or dispersed by means of a dispersion machine such as a homogenizer, a ball mill, a colloid mill or an ultrasonic dispersion machine. The monomer composition thus obtained is suspended in an aqueous medium containing an inorganic dispersant. Here, a high-speed dispersion machine such as a high-speed stirrer or an ultrasonic dispersion machine may be used to make the toner particles have the desired particle size at a stretch. This can more make the resultant toner particles have a sharp particle size distribution. As the time at which a polymerization initiator is added, it may previously be added to the monomer composition, or may be added after the monomer composition has been suspended in the aqueous medium.

After suspension, the system may be stirred using a usual stirrer in such an extent that the state of particles is maintained and also the particles can be prevented from floating and settling. Here, in the present invention, when the monomer composition is suspended, the pH may preferably be from 4 to 10.5. If the pH is less than 4, the toner may have a broad particle size distribution. If on the other hand the pH is more than 10.5, the toner may have a low chargeability.

In the suspension polymerization, any known surface-active agent or organic or inorganic dispersant may be used as a dispersant. In particular, the inorganic dispersants may hardly loose the stability even when reaction temperature is changed, and hence may preferably be used. As examples of such an inorganic dispersant, they may include phosphoric acid polyvalent metal salts such as tricalcium phosphate, magnesium phosphate, aluminum phosphate and zinc phosphate; carbonates such as calcium carbonate and magnesium carbonate; inorganic salts such as calcium metasilicate, calcium sulfate and barium sulfate; and inorganic oxides such as calcium hydroxide, magnesium hydroxide, aluminum hydroxide, silica, bentonite and alumina.

Any of these inorganic dispersants may preferably be used alone or in combination of two or more types in an amount of from 0.2 part by mass to 20 parts by mass based on 100 parts by mass of the polymerizable monomer. Where a toner made into finer particles like those of 5 μm or less in average particle diameter, a surface-active agent used may used in combination in an amount of from 0.001 part by mass to 0.1 part by mass.

Such a surface-active agent may include, e.g., sodium dodecylbenezene sulfate, sodium tetradecyl sulfate, sodium pentadecyl sulfate, sodium octyl sulfate, sodium oleate, sodium laurate, sodium stearate and potassium stearate.

When these inorganic dispersants are used, they may be used as they are. In order to obtain finer particles, particles of the inorganic dispersant may be formed in the aqueous medium. Stated specifically, e.g., in the case of tricalcium phosphate, an aqueous sodium phosphate solution and an aqueous calcium chloride solution may be mixed under high-speed stirring, whereby sparingly water-soluble calcium phosphate can be formed and more uniform and finer dispersion can be made. The inorganic dispersant can substantially completely be removed by dissolving it with an acid or an alkali after the polymerization is completed.

In the step of polymerization, the polymerization may be carried out at a polymerization temperature set at 40° C. or above, and commonly at a temperature of from 50° C. to 90° C. Where polymerization is carried out in this temperature range, the binder resin and the wax become phase-separated from each other with progress of the polymerization, so that a toner can be obtained in which the wax stand enclosed inside the toner particles. It is also preferable to raise the reaction temperature to 90° C. to 150° C. at the termination of polymerization reaction.

The toner of the present invention may be used as a toner for a one-component developer, or may also be used as a toner for a two-component developer having a carrier.

Where it is used as the two-component developer, it is used as a developer prepared by blending the toner of the present invention and a carrier. The carrier is constituted solely of element selected from iron, copper, zinc, nickel, cobalt, manganese and chromium elements, or in the form of a composite ferrite. As particle shape of the carrier, the particles may be spherical, flat or shapeless, any of which may be used. It is also preferable to control the microstructure of carrier particle surfaces (e.g., surface unevenness).

As a method for producing the carrier, a method is available in which the ferrite is fired and granulated to beforehand form carrier core particles, the surface of which are thereafter coated with a resin. From the meaning of lessening the load of the carrier to the toner, what may also be used is a method in which the ferrite and the resin are kneaded, followed by pulverization and classification to obtain a low-density dispersed carrier, or further a method in which a kneaded product of the ferrite and a monomer is directly subjected to suspension polymerization in an aqueous medium to obtain a true-spherical carrier.

A coated carrier obtained by coating the surfaces of the carrier core particles with a resin may particularly preferably be used. As production methods therefor, available are a method in which a resin is dissolved or suspended in a solvent and the solution or suspension obtained is applied to carrier core particles to make the former adhere to the latter, and a method in which a resin powder and the carrier core particles are merely mixed to make the former adhere to the latter.

The material with which the surfaces of carrier core particles are to be coated may differ depending on toner materials. For example, it may include polytetrafluoroethylene, monochlorotrifluoroethylene polymer, polyvinylidene fluoride, silicone resins, polyester resins, styrene resins, acrylic resins, polyamide, polyvinyl butyral, and aminoacrylate resins. Any of these may be used alone or in combination of two or more types.

As magnetic characteristics of the carrier, it may preferably have a magnetization intensity (σ1,000) of from 30 to 300 emu/cm$^3$ at 79.6 kA/m (1 kilooersteds) after it has been magnetically saturated. In order to achieve a higher image quality, it may preferably be from 100 to 250 emu/cm$^3$. If the magnetization intensity is more than 300 emu/cm$^3$, it may be difficult to obtain toner images having a high image quality. If conversely it is less than 30 emu/cm$^3$, the carrier may have less magnetic binding force to tend to cause carrier adhesion.

The carrier may preferably have a particle shape that SF-1 showing the degree of roundness is 180 or less and SF-2 showing the degree of unevenness is 250 or less. The SF-1 and SF-2 are defined by the following expressions, and are measured with LUZEX-3, manufactured by Nireco Corp.

$$SF\text{-}1=\{(\text{maximum length of carrier particle})^2/\text{projected area of carrier particle}\}\times\pi/4\times100.$$

$$SF\text{-}2=\{(\text{peripheral length of carrier particle})^2/\text{projected area of carrier particle}\}\times1/4\pi\times100.$$

Where the toner of the present invention and the above carrier are blended to prepare the two-component developer, they may preferably be blended in a proportion of from 2% by mass to 15% by mass, and much preferably from 4% by mass to 13% by mass, as toner concentration in the developer.

Measurement for Loss Tangent (tan δ) Curve and Storage Elastic Modulus (G') Curve by Dynamic Viscoelasticity Test How to measure the storage elastic modulus (G') by the dynamic viscoelasticity test in the present invention is described below.

As a measuring instrument, ARES (manufactured by Rheometric Scientific F.E. Ltd.) may be used, for example. The storage elastic modulus in the temperature range of from 25° C. to 200° C. is measured under the following conditions.

Measuring jig: Circular parallel plates of 8 mm each in diameter are used.

Measuring sample: Where the true density of the toner is represented by ρ, (0.12×ρ) g of the toner is weighed, and then, under application of 20 kN for 2 minutes, molded into a disk of 8 mm in diameter and about 1 mm in thickness to prepare a measuring sample.

Measurement frequency: 6.28 radian/second.

Setting of measurement strain: The initial value is set at 0.1%, and thereafter the measurement is made in an automatic measuring mode.

Extension correction of sample: Adjusted in the automatic measuring mode.

Measurement temperature: The elastic modulus is measured at a heating rate of 1° C. per minute from 20° C. to 200° C. and at intervals of 30 seconds.

Measurement of True Density of Toner

The true density of the toner may be measured by a method making use of a gaseous displacement type pycnometer. As the principle of measurement, a shut-off valve is provided between a sample chamber with preset volume (volume $V_1$) and a comparison chamber (volume $V_2$), and mass ($M_0$ g) is beforehand measured. Thereafter, the sample is put into the sample chamber. The interiors of the sample chamber and comparison chamber are filled with an inert gas such as helium, and pressure at that point is represented by $P_1$. The shut-off valve is closed, and then inert gas is added to only the sample chamber. Pressure at that point is represented by $P_2$. The shut-off valve is opened to connect the sample chamber and the comparison chamber with each other, where pressure in the system at that point is represented by $P_3$. Volume of the sample, $V_0$ ($cm^3$), may be determined according to the following expression A. The true density of the sample, $\rho_T$ ($g/cm^3$), may be determined according to the following expression B.

$$V_0=V_1-[V_2/\{(P_2-P_1)/(P_3-P_1)-1\}]. \quad \text{Expression A}$$

$$\rho_T=M_0/V_0. \quad \text{Expression B}$$

For example, it may be measured with a dry automatic densitometer ACCUPYC 1330 (manufactured by Shimadzu Corporation). In this measurement, a sample container of 10 $cm^3$ in capacity is used, and, as sample pre-treatment, purging with helium gas is carried out 10 times at a maximum pressure of 19.5 psig (134.4 kPa). Thereafter, as a value of pressure equilibrium judgment on whether or not the internal pressure of the container has come into equilibrium, a value of 0.0050 psig/minute that is scale deflection of the internal pressure of the sample chamber is set as a standard, and the pressure is regarded as being in the state of equilibrium when it is not higher than this value, where the measurement is started to measure the true density automatically. The measurement is made five times, and an average value thereof is found and is given as the true density ($g/cm^3$).

Measurement of Glass Transition Point (Tg) and Melting Point (Tm) of Toner and Other Materials In the present invention, the glass transition point (Tg) and the melting point (Tm) are measured with a differential scanning calorimeter (DSC). Stated specifically, Q1000 (manufactured by TA Instruments Japan Ltd.) is used as the DSC. As a measuring method, 4 mg of a sample is precisely weighed out into an aluminum pan, and an empty pan is used as a reference pan, where the measurement is made in an atmosphere of nitrogen, at modulation amplitude of 0.5° C. and at a frequency of 1/minute. The measurement temperature is set at 10° C., which is retained for 10 minutes, and thereafter shifted from 10° C. to 180° C. at a heating rate of 1° C./minute. The reversing heat flow curve obtained is used as a DSC curve, and this is used to determine the Tg by the middle-point method. Here, the glass transition point determined by the middle-point method is, in the DSC curve at the time of heating (temperature rise), the point at which the middle line between the base line before appearance of an endothermic peak and the base line after appearance of the endothermic peak and a rising curve intersect, which point is given as the glass transition point (see FIG. 1).

To measure the maximum endothermic peak temperature (melting point) of the toner and its endothermic quantity, in a region which is, in the reversing heat flow curve obtained by measurement in the same way as the above, surrounded with a straight line and an endothermic peak curve which straight line connects i) a point at which the endothermic peak curve separates from the extrapolated line of the base line before appearance of the endothermic peak and ii) a point at which the extrapolated line of the base line after termination of the endothermic peak and the endothermic peak curve come into contact, the temperature that comes to a relative maximal value in the endothermic peak curve is given as the maximum endothermic peak temperature. Where two or more relative maximal values are present in the endothermic peak curve, the temperature at a relative maximal value where the distance between i) the straight line connecting the above points and ii) the relative maximal value is longer in the region surrounded as above is given as the maximum endothermic peak temperature (melting point). Also where two or more regions surrounded as above are independently present, like the above, the temperature at a relative maximal value where the distance between i) the straight line connecting the above points and ii) the relative maximal value is longer is given as the maximum endothermic peak temperature (melting point).

As to the endothermic quantity, an endothermic quantity (J/g) is determined from the area (integral value of melting peak) of the region which is, in the reversing heat flow curve obtained by the above measurement, surrounded with a straight line and an endothermic peak curve which straight line connects i) a point at which the endothermic peak curve separates from the extrapolated line of the base line before appearance of the endothermic peak and ii) a point at which the extrapolated line of the base line after termination of the endothermic peak and the endothermic peak curve come into contact. Where two or more regions surrounded as above are independently present, the sum total of these is given as the endothermic quantity.

The glass transition point (Tg) and melting point (Tm) of the other materials are also measured in the same way as the above.

Measurement of Molecular Weight by GPC

How to measure the molecular weight in terms of polystyrene (PSt) by gel permeation chromatography (GPC) in the present invention is described below.

Columns are stabilized in a heat chamber of 40° C. To the columns kept at this temperature, THF (tetrahydrofuran) as a solvent is flowed at a flow rate of 1 ml per minute, and 100 μl of a sample THF solution is injected thereinto to make measurement. In measuring the molecular weight of the sample, the molecular weight distribution the sample has is calculated from the relationship between the logarithmic value of a calibration curve prepared using several kinds of monodisperse polystyrene standard samples and the number of count. As the standard polystyrene samples used for the preparation of the calibration curve, it is suitable to use samples with molecular weights of approximately from 100 to 10,000,000 and to use at least about 10 standard polystyrene samples. Stated specifically, e.g., standard polystyrenes EasiCal PS-1 (a mixture of those of 7,500,000, 841,700, 148,000, 28,500 and 2,930 in molecular weight and those of 2,560,000, 320,000, 59,500, 9,920 and 580 in molecular weight) and PS-2 (a mixture of those of 377,400, 96,000, 19,720, 4,490 and 1,180 in molecular weight and those of 188,700, 46,500, 9,920, 2,360 and 580 in molecular weight), which are available from Polymer Laboratories Inc., may be used in combination. An RI (refractive index) detector is used as a detector. Columns should be used in combination of a plurality of commercially available polystyrene gel columns. For example, they may preferably include a combination of Shodex GPC KF-801, KF-802, KF-803, KF-804, KF-805, KF-806, KF-807 and KF-800P, available from Showa Denko K.K.; and a combination of TSKgel G1000H($H_{XL}$) G2000H($H_{XL}$) G3000H($H_{XL}$) G4000H($H_{XL}$) G5000H($H_{XL}$) G6000H($H_{XL}$), G7000H($H_{XL}$) and TSK guard column, available from Tosoh Corporation.

The maximal value (Mp) and weight average molecular weight (Mw) of the THF-soluble component the toner of the present invention has are determined from the molecular weight distribution obtained by the above method.

The sample used in the GPC instrument is prepared in the following way.

The sample to be measured is put in THF and well mixed, and this is left to stand for 18 hours. Thereafter, the solution having been passed through a sample treating filter (pore size: 0.45 to 0.5 μm; e.g., MAISHORIDISK H-25-5, available from Tosoh Corporation, or EKIKURODISK 25CR, available from German Science Japan, Ltd., may be used) is used as the sample for GPC. The sample to be measured is made in a concentration of 5 mg/ml based on the THF.

The weight average molecular weight (Mw), number average molecular weight (Mn) and so forth of the wax and other resin used in the present invention may also be measured in the same way as the above.

Measurement of Acid Value of Resin

The acid value of the resin is determined in the following way. Basic operation is made according to JIS K0070.

The number of milligrams of potassium hydroxide necessary to neutralize free fatty acid, resin acid and the like contained in 1 g of a sample is termed as the acid value, and is measured according to the following procedure.

(1) Reagent (a) Preparation of Solvent

An ethyl ether/ethyl alcohol mixture solution (1+1 or 2+1) or a benzene/ethyl alcohol mixture solution (1+1 or 2+1) is used. These solutions are each kept neutralized with a 0.1 mol/liter potassium hydroxide ethyl alcohol solution using phenolphthalein as an indicator immediately before use.

(b) Preparation of Phenolphthalein Solution 1 g of phenolphthalein is dissolved in 100 ml of ethyl alcohol (95 v/v %).

(c) Preparation of 0.1 Mol/Liter Potassium Hydroxide/Ethyl Alcohol Solution 7.0 g of potassium hydroxide is dissolved in water used in a quantity as small as possible, and ethyl alcohol (95 v/v %) is added thereto to make up a 1 liter solution, which is then left to stand for 2 or 3 days, followed by filtration. Standardization is made according to JIS K8006 (basic items relating to titration during a reagent content test).

(2) Operation

From 1 to 20 g of the sample is accurately weighed, and 100 ml of the solvent and few drops of the phenolphthalein solution as an indicator are added thereto, which are then thoroughly shaken until the sample dissolves completely. In the case of a solid sample, it is dissolved by heating on a water bath. After cooling, the resultant solution is titrated with the 0.1 mol/liter potassium hydroxide/ethyl alcohol solution, and the time by which the indicator has continued to stand sparingly red for 30 seconds is regarded as the end point of neutralization.

(3) Calculation

The acid value is calculated according to the following equation.

$$A=(B\times f\times 5.611)/S.$$

A: the acid value (mgKOH/g);

B: the amount (ml) of the 0.1 mol/liter potassium hydroxide/ethyl alcohol solution used;

f: the factor of the 0.1 mol/liter potassium hydroxide/ethyl alcohol solution; and S: the sample (g).

Measurement of Average Circularity of Toner

The average circularity of the toner may be measured with a flow type particle image analyzer "FPIA-3000" (manufactured by Sysmex Corporation).

A specific way of measurement is as follows: First, about 20 ml of ion-exchanged water, from which impurity solid matter and the like have beforehand been removed, is put into a container made of glass. To this water, about 0.2 ml of a dilute solution is added as a dispersant, which has been prepared by diluting "CONTAMINON N" (an aqueous 10% by mass solution of a pH 7 neutral detergent for washing precision measuring instruments which is composed of a nonionic surface-active agent, an anionic surface-active agent and an organic builder and is available from Wako Pure Chemical Industries, Ltd.) with ion-exchanged water to about 3-fold by mass. Further, about 0.02 g of a measuring sample is added, followed by dispersion treatment for 2 minutes by means of an ultrasonic dispersion machine to prepare a liquid dispersion for measurement. In that course, the dispersion system is appropriately so cooled that the liquid dispersion may have a temperature of 10° C. or more to 40° C. or less. As the ultrasonic dispersion machine, an ultrasonic dispersion machine of 50 kHz in oscillation frequency and 150 W in electric output (e.g., "VS-150", manufactured by Velvo-Clear Co.) is used. Into its water tank, a stated amount of ion-exchanged water is put, and about 2 ml of the above CONTAMINON N is fed into this water tank.

In the measurement, the flow type particle image analyzer is used, having a standard objective lens (10 magnifications), and Particle Sheath PSE-900A (available from Sysmex Corporation) is used as a sheath solution. The liquid dispersion having been controlled according to the above procedure is introduced into the flow type particle analyzer, where 3,000 toner particles are counted in an HPE measuring mode and in a total count mode. Then, the binary-coded threshold value at the time of particle analysis is set to 85%, and the diameter of particles to be analyzed are limited to circle-equivalent diameter of from 1.985 μm or more to less than 39.69 μm, where the average circularity of toner particles is determined.

In measuring the circularity, before the measurement is started, autofocus control is performed using standard latex particles (e.g., "RESEARCH AND TEST PARTICLES Latex Microsphere Suspensions 5200A", available from Duke Scientific Corporation). Thereafter, the autofocus control may preferably be performed at intervals of 2 hours after the measurement has been started.

In Examples of the present invention, a flow type particle image analyzer was used on which correction was operated by Sysmex Corporation and for which a correction certificate issued by Sysmex Corporation was issued. Measurement was made under the measurement and analysis conditions set when the correction certificate was received, except that the diameter of particles to be analyzed were limited to the circle-equivalent diameter of from 1.985 μm or more to less than 39.69 μm.

The principle of measurement with the flow type particle image analyzer "FPIA-3000" (manufactured by Sysmex Corporation) is that particles flowing therein are photographed as still images and the images are analyzed. The sample fed to a sample chamber is sent into a flat sheath flow cell by the aid of a sample suction syringe. The sample having been sent into the flat sheath flow cell forms a flat flow in the state it is inserted in sheath solution. The sample passing through the interior of the flat sheath flow cell is kept irradiated with strobe light at intervals of 1/60 second, thus the particles flowing therethrough can be photographed as still images. Also, because of the flat flow, the particles the particles kept flowing can be photographed in a focused state. Particle images are photographed with a CCD camera, and the images photographed are image-processed at an image processing resolution of 512×512 (0.37 μm×0.37 μm per pixel), and the contour of each particle image is abstracted, where the projected area S and peripheral length L of the particle image are measured.

Next, the projected area S and peripheral length L are used to determine circle-equivalent diameter and circularity. The circle-equivalent diameter refers to the diameter of a circle having the same area as the projected area of the particle image. Circularity C is defined as a value found when the peripheral length of a circle that is found from the circle-equivalent diameter is divided by the peripheral length of particle projected area, and is calculated according to the following expression.

$$\text{Circularity } C=[2\times(\pi\times S)^{1/2}]/L.$$

The circularity is 1 when the particle image is circular. The larger the degree of unevenness of the periphery of the particle image is, the smaller the circularity is. The circularity of each particle is calculated, and thereafter the range of circularities of from 0.200 to 1.000 is divided into 800, where the arithmetic mean of the circularities obtained is calculated and its value is taken as average circularity.

Measurement of Weight Average Particle Diameter (D4) and D4/D1 of Toner and Colored Particles The weight average particle diameter (D4) and value of D4/D1 of the toner and colored particles may specifically be measured by the following method.

Coulter counter Multisizer II (manufactured by Coulter Electronics, Inc.) is used as a measuring instrument. As an electrolytic solution, an aqueous solution of about 1% NaCl is prepared using first-grade sodium chloride. For example, ISOTON R-II (available from Coulter Scientific Japan Co.) may be used. As a method of measurement, 0.1 ml to 5 ml of a surface-active agent (preferably an alkylbenzenesulfonate) as a dispersant is added to 100 ml to 150 ml of the above aqueous electrolytic solution, and further 2 mg to 20 mg of a sample for measurement is added. The electrolytic solution in which the sample has been suspended is subjected to dispersion for about 1 minute to about 3 minutes in an ultrasonic dispersion machine. The volume distribution and number distribution of the toner are calculated by measuring the volume and number for each channel in respect of particles of from 2.00 μm to 40.30 μm in particle diameter by means of the above measuring instrument, using an aperture of 100 μm as its aperture. The weight average particle diameter (D4) (the middle value of each channel is used as the representative value for each channel) and number average particle diameter (D1) of the toner particles are determined from these distributions. As channels, 13 channels are used, which are of 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm, and 32.00 to 40.30 μm. The value of D4/D1 is a value found by dividing D4 by D1.

Measurement of Content of Sulfur Element Derived from Sulfonic Acid Group and that of Sulfonic Acid Group Elastic Material has, by Fluorescent X-Ray Measurement These are measured with a wavelength dispersion type X-ray measuring instrument "Axios Advanced" (manufactured by PANalytical Co.). About 3 g of a sample material used for measurement is put in a ring for measurement which is of 27 mm in diameter and made of vinyl chloride, and then molded by pressing it at 200 kN to prepare a sample. The mass of the sample material used and the thickness of the sample obtained by molding are measured, and the content of sulfur element derived from sulfonic acid groups contained in the sample material is determined as an input value for calculating the content. Conditions for elementary analysis and conditions for quantitative analysis are shown below.

Conditions for Elementary Analysis

Analytical method: Fundamental parameter method

Elements to be analyzed: Measured on elements of from boron B to uranium U in the periodic table.

Measurement atmosphere: Vacuum

Measuring sample: Solid

Collimeter mask diameter: 27 mm

Measurement condition: An automatic program is used which has beforehand been set under conditions optimal for each element.

Measurement time: About 20 minutes

Others: Common values the instrument recommends are used.

Quantitative Analysis

Analytical program: UniQuant 5

Analytical conditions: Oxide form

Balance component: $CH_2$

Others: Common values the instrument recommends are used.

Measurement of Zeta Potential of Colored Particles and Elastic Material

The zeta potential of the colored particles and elastic material may be measured with a zeta potential measuring instrument of a laser Doppler electrophoretic system. Stated specifically, it may be measured with Zetasizer Nano ZS (model: ZEN3600, manufactured by Malvern Instruments Ltd.).

The solid matter concentration of the colored particles or elastic material is so adjusted with ion-exchanged water as to be 0.05% by mass. The pH is so adjusted with hydrochloric acid or sodium hydroxide as to be 7.0. 20 ml of the liquid dispersion obtained is subjected to dispersion treatment for 3 minutes by means of an ultrasonic cleaner (BRANSONIC 3510, manufactured by Branson Co.). Using this, the zeta potential is measured by a method recommended in instrument instructions, except that the following conditions are set. The values of zeta potential (mV) are represented by $Z_2$ (mV) for the colored particles and by $Z_{1p}$ (mV) for the elastic material.

Cell: DTS1060C, a clear disposable zeta cell

Dispersant: Water

Measurement duration: Automatic

Model: Smoluchowski

Temperature: 25.0° C.

Result calculation: General purpose

An integral curve of a zeta potential distribution curve [a zeta potential (mV) (x-axis)-intensity (Kcps) (y-axis) curve] obtained by the above measurement is also determined, and values on this y-axis are converted into percentage to prepare a zeta potential (mV) (x-axis)-integral value percentage (%) (y-axis) curve. From this curve, the value on the x-axis at a point where the value on the y-axis is 10.0% is read and this is represented by $Z_{p10}$ (mV), and the value on the x-axis at a point where the value on the y-axis is 90.0% is read and this is represented by $Z_{p90}$ (mV).

EXAMPLES

The present invention is described below in greater detail by giving production examples and working examples, which, however, by no means limit the present invention.

Elastic Material

Production Example 1

The following raw-materials were put into a reaction vessel provided with a cooling tube, a stirrer and a nitrogen feed tube, and then allowed to react with one another at 260° C. for 8 hours, followed by cooling to 240° C., where the system was brought to a reduced pressure of 1 mmHg over a period of 1 hour. The reaction was further carried out for 3 hours to obtain polyester having sulfonic acid groups.

Alcohol Monomers

Polyoxypropylene(2.2)-2,2-bis(4-hydroxyphenyl)propane (BPA-PO): 40 mol % (138 parts by mass)

Polyoxyethylene(2.2)-2,2-bis(4-hydroxyphenyl)propane (BPA-EO): 5 mol % (16 parts by mass)

Ethylene glycol: 70 mol % (43 parts by mass)

Acid Monomers

Terephthalic acid: 95 mol % (158 parts by mass)

Trimellitic acid: 5 mol % (10 parts by mass)

5-Sodium sulfoisophthalate: 4.8 mol % (9.7 parts by mass)

Catalyst

Tetrabutyl titanate: 0.1 mol % (0.28 part by mass).

100 parts by mass of the above polyester, 50 parts by mass of methyl ethyl ketone and 50 parts by mass of tetrahydrofuran were put into a reaction vessel provided with a cooling tube, a stirrer and a nitrogen feed tube, and then heated to 75° C. To this, 300 parts by mass of 75° C. water was added, and these were stirred for 1 hour. The mixture obtained was heated to 95° C. and stirred for 3 hours, followed by cooling to 30° C. to obtain a liquid dispersion of an elastic material 1. Its physical properties are shown in Table 1 and Table 1-2.

Elastic Material

Production Examples 2 to 5

Elastic materials 2 to 5 were obtained in the same way as in Elastic Material Production Example 1 except for those shown in Table 2. Their physical properties are shown in Table 1 and Table 1-2.

Non-Crystalline Polyester

Production Example

The following raw-materials were put into a reaction vessel provided with a cooling tube, a stirrer and a nitrogen feed tube, and then allowed to react with one another at 260° C. for 8 hours, followed by cooling to 240° C., where the system was brought to a reduced pressure of 1 mmHg over a period of 1 hour. The reaction was further carried out for 3 hours to obtain non-crystalline polyester.

Alcohol Monomers

Polyoxypropylene(2.2)-2,2-bis(4-hydroxyphenyl)propane (EPA-PO): 25 mol % (86 parts by mass)

Ethylene glycol: 105 mol % (65 parts by mass)

Polyoxypropylene(2.2)-2,2-bis(4-hydroxyphenyl)propane (BPA-PO): 25 mol % (86 parts by mass)

Ethylene glycol: 105 mol % (65 parts by mass)

Polyoxypropylene(2.2)-2,2-bis(4-hydroxyphenyl)propane (BPA-PO): 25 mol % (86 parts by mass)

Ethylene glycol: 105 mol % (65 parts by mass)

Tetrabutyl titanate: 0.1 mol % (0.28 part by mass).

Acid Monomers

Terephthalic acid: 85 mol % (141 parts by mass)

Trimellitic acid: 15 mol % (29 parts by mass).

Catalyst

The above non-crystalline polyester had a weight average molecular weight of 18,900, a number average molecular weight of 11,200, a glass transition point of 72° C. and an acid value of 10.6 mgKOH/g.

Example 1

| | |
|---|---|
| Styrene | 59 parts by mass |
| N-Butyl acrylate | 41 parts by mass |
| Pigment Blue 15:3 | 6 parts by mass |
| Salicylic acid aluminum compound (BONTRON E-88, available from Orient Chemical Industries, Ltd.) | 1 part by mass |
| Divinylbenzene | 0.015 part by mass |
| Above non-crystalline polyester | 2.4 parts by mass |
| Carnauba wax | 12 parts by mass |

A monomer mixture composed of the above was prepared. Ceramic beads of 15 mm in diameter were added thereto, and these were subjected to dispersion by means of an attritor for 2 hours to obtain a monomer composition.

800 parts by mass of ion-exchanged water and 3.5 parts by mass of tricalcium phosphate were put into a high-speed stirrer TK homomixer (manufactured by Tokushu Kika Kogyo Co., Ltd.), and then, adjusting the number of revolution to 12,000 revolutions per minute, heated to 70° C. to make up a dispersing medium system.

To the above monomer composition, 4 parts by mass of a polymerization initiator t-butyl peproxy-2-ethylhexanoate (TBEH) was added, and these were introduced into the dispersing medium system. Keeping 12,000 revolutions per minute, the high-speed stirrer was operated to carry out a granulation step for 3 minutes. Thereafter, the high-speed stirrer was changed for a stirrer having propeller stirring blades, and the polymerization was carried out at 150 revolutions per minute for 10 hours. The product formed was cooled to 50° C. to obtain a colored particles liquid dispersion.

A portion of the colored particles liquid dispersion was cooled to 20° C. and then collected, where physical properties as the liquid dispersion were measured. Another portion of the same was dried to prepare a sample for measurement. The physical properties of the colored particles are shown in Table 3-2.

16.8 parts by mass (solid content: 4.2 parts by mass) of the elastic material 1, beforehand heated to 50° C., was added to the above colored particles liquid dispersion. These were stirred for 1 hour as they were, and thereafter dilute hydrochloric acid was added, where the pH of the reaction system was adjusted to 1.8 over a period of 2 hours. Next, as heat treatment, the system was heated to 66.0° C. and continued being stirred for 2 hours, and thereafter cooled to 20° C., followed by filtration, washing and then drying to obtain toner particles.

Above toner particles 1:100 parts by mass.

Hydrophobic titanium oxide having been treated with $n\text{-}C_4H_9Si(OCH_3)_3$ (BET specific surface area: 120 $m^2/g$): 1 part by mass.

Hydrophobic silica having been treated with hexamethyldisilazane and thereafter treated with silicone oil (BET specific surface area: 160 $m^2/g$): 1 part by mass.

A mixture composed of the above was mixed by means of Henschel mixer to obtain Toner 1.

Using the above Toner 1, evaluation described below was made. Physical properties of Toner 1 are shown in Tables 4, 5 and 5-2, and evaluation results are shown in Table 6.

Examples 2 to 11

Toners 2 to 11 were obtained in the same manner as in Example 1 except that the amounts of the monomers and so forth used and the temperature and time for the heat treatment carried out after the pH was adjusted to 1.8 were changed to conditions shown in Table 3. These Toners 2 to 11 were also evaluated in the same way as in Example 1. A portion of the colored particles liquid dispersion was cooled to 20° C. and then collected, where physical properties as the liquid dispersion were measured. The physical properties of the colored particles are shown in Table 3-2, physical properties of each toner are shown in Tables 4, 5 and 5-2, and evaluation results are shown in Table 6.

Comparative Example 1

Toner 12 was obtained in the same manner as in Example 1 except that, in Example 1, the liquid dispersion of the elastic material 1 was not added. This Toner 12 was evaluated in the same way as in Example 1. Physical properties of toner particles were also measured in the same way as the measurement of physical properties of the colored particles in Example 1. The physical properties of toner particles are shown in Table 3-2. Physical properties of the toner are shown in Tables 4, 5 and 5-2, and evaluation results are shown in Table 6.

Comparative Example 2

Toner 13 was obtained in the same manner as in Example 1 except that, in Example 1, the liquid dispersion of the elastic material 1 was dried and 4.2 parts by mass of the dried product obtained was added to, and dissolved previously in, the monomer composition. This Toner 13 was evaluated in the same way as in Example 1. Physical properties of toner particles were also measured in the same way as the measurement of physical properties of the colored particles in Example 1. The physical properties of toner particles are shown in Table 3-2. Physical properties of the toner are shown in Tables 4, 5 and 5-2, and evaluation results are shown in Table 6.

Comparative Example 3

Toner 14 was obtained in the same manner as in Comparative Example 1 except that, in Comparative Example 2, the amount of the dried product added was changed to 8.4 parts by mass. This Toner 14 was evaluated in the same way as in Example 1. Physical properties of toner particles were also measured in the same way as the measurement of physical properties of the colored particles in Example 1. The physical properties of toner particles are shown in Table 3-2. Physical properties of the toner are shown in Tables 4, 5 and 5-2, and evaluation results are shown in Table 6.

Comparative Example 4

Toner 15 was obtained in the same manner as in Example 1 except that, in Example 1, the procedure that the elastic material 1 was added to the colored particles liquid dispersion, and these were stirred for 1 hour, and thereafter dilute hydrochloric acid was added, where the pH of the reaction system was adjusted to 1.8 over a period of 2 hours was so changed that the dilute hydrochloric acid was added, the pH of the reaction system was adjusted to 1.8 over a period of 2 hours, and thereafter the elastic material 1, having been heated to 50° C., was added to the colored particles liquid dispersion and these were stirred for 30 minutes. This Toner 15 was evaluated in the same way as in Example 1. Physical properties of colored particles were also measured in the same way as in Example 1. The physical properties of colored particles are shown in Table 3-2, physical properties of this Toner 15 are shown in Tables 4, 5 and 5-2, and evaluation results are shown in Table 6.

Comparative Example 5

Toner 16 was obtained in the same manner as in Comparative Example 4 except that, in Comparative Example 4, the amount of the elastic material 1 was changed to 8.4 parts by mass as amount in terms of solid matter. This Toner 16 was evaluated in the same way as in Example 1. Physical properties of colored particles were also measured in the same way as in Example 1. The physical properties of colored particles are shown in Table 3-2, physical properties of this Toner 16 are shown in Tables 4, 5 and 5-2, and evaluation results are shown in Table 6.

Comparative Example 6

Toner 17 was obtained in the same manner as in Example 1 except that, in Example 1, the liquid dispersion of the elastic material 1 was changed for a liquid dispersion of the elastic material 5. This Toner 17 was evaluated in the same way as in Example 1. Physical properties of colored particles were also measured in the same way as in Example 1. The physical properties of colored particles are shown in Table 3-2, physical properties of this Toner 17 are shown in Tables 4, 5 and 5-2, and evaluation results are shown in Table 6.

Comparative Example 7

Colored particles liquid dispersion was obtained in the same manner as in Example 1 except that, in Example 1, the non-crystalline polyester was not added and, in place of the tricalcium phosphate, 4.2 parts by mass of polyvinyl alcohol (degree of polymerization: 500) having a degree of saponification of 86.5 mol % to 89 mol % was used.

This colored particles liquid dispersion was heated to 80° C., and 3.5 parts by mass of tricalcium phosphate was added thereto. Further, 16.8 parts by mass (solid content: 4.2 parts by mass) of the elastic material 1 was added to the colored particles liquid dispersion, and these were stirred for 30 minutes. These were further continued being stirred for 3 hours, and thereafter cooled to 20° C., followed by filtration, washing and then drying to obtain toner particles.

Next, Toner 18 was obtained in the same manner as in Example 1. This Toner 18 was evaluated in the same way as in Example 1. Physical properties of colored particles were also measured in the same way as in Example 1. The physical properties of colored particles are shown in Table 3-2, physical properties of this Toner 18 are shown in Tables 4, 5 and 5-2, and evaluation results are shown in Table 6.

Comparative Example 8

Toner particles were obtained in the same manner as in Comparative Example 1. Using Henschel mixer, the toner particles and 4.2 parts by mass of the dried product of the elastic material 1 were mixed at 2,000 revolutions per minute for 3 minutes. Thereafter, the mixture obtained was introduced into Hybridizer Model I (manufactured by Nara Machinery Co., Ltd.), and then treated at 6,000 rpm for 3 minutes to obtain surface-treated toner particles.

Above surface-treated toner particles 1:100 parts by mass.

Hydrophobic titanium oxide having been treated with $n\text{-}C_4H_9Si(OCH_3)_3$ (BET specific surface area: 120 $m^2/g$): 1 part by mass.

Hydrophobic silica having been treated with hexamethyldisilazane and thereafter treated with silicone oil (BET specific surface area: 160 $m^2/g$): 1 part by mass.

A mixture composed of the above was mixed by means of Henschel mixer to obtain Toner 19. This Toner 19 was evaluated in the same way as in Example 1. Physical properties of colored particles are shown in Table 3-2, and physical properties of this Toner 19 are shown in Tables 4, 5 and 5-2, and evaluation results are shown in Table 6.

How to Evaluate Anti-Blocking Performance 5 g of the toner was weighed in 100 ml polyethylene cups each, which were then respectively put into a hot-air drier controlled to 50° C. and a chamber controlled to 25° C., and then left to stand for a week. The polyethylene cups were gently taken out, and were slowly rotated, where the fluidity of the toner was compared between the toner left to stand at 50° C. and the toner left to stand at 25° C., to make evaluation by visual observation.

A: The fluidity of the toner left to stand at 50° C. is equal, compared with the toner left to stand at 25° C.

B: The fluidity of the toner left to stand at 50° C. is a little inferior, compared with the toner left to stand at 25° C., but the fluidity is gradually recovered as the polyethylene cup is rotated.

C: In the toner left to stand at 50° C., lumps are seen in which particles stand agglomerate and fused.

D: The toner left to stand at 50° C. does not flow.

How to Evaluate Low-Temperature Fixing Performance, Anti-Offset Performance, Anti-Soaking Performance and Color Ranging Performance A commercially available color laser printer (LBP-5500, manufactured by CANON INC.) was used. A toner of its cyan cartridge was taken out, and Toner 1 was filled in this cartridge. The cartridge was set at the cyan station, and toner images, which were unfixed, of 2.0 cm in length and 15.0 cm in width (0.6 $mg/cm^2$ for each of the toner images) were formed on image-receiving paper (OFFICE PLANNER 64 $g/m^2$, available from CANON INC.) at an area up to 2.0 cm from its upper end and an area up to 2.0 cm from its lower end with respect to the direction of paper feed. Next, a fixing unit detached from the commercially available color laser printer (LBP-5500, manufactured by CANON INC.) was so converted that its fixing temperature and process speed were controllable. Using this, the fixing of the unfixed image was tested. In a normal-temperature and normal-humidity environment (23° C./60% RH), setting the process speed at 240 mm/second, and while changing the preset temperature at intervals of 10° C. in the range of from 120° C. to 240° C., the toner images were fixed at each temperature. The low-temperature fixing performance, anti-offset performance, anti-soaking performance and color ranging performance of each toner were evaluated according to the evaluation criteria shown below.

Low-Temperature Fixing Performance

A: Low-temperature offset does not occur at 120° C. or more, and any toner does not come off even when rubbed with fingers.

B: Low-temperature offset does not occur at 130° C. or more, and any toner does not come off even when rubbed with fingers.

C: Low-temperature offset does not occur at 140° C. or more, and any toner does not come off even when rubbed with fingers.

D: Low-temperature offset does not occur at 150° C. or more, and any toner does not come off even when rubbed with fingers.

E: Low-temperature offset does not occur at 160° C. or more, and any toner does not come off even when rubbed with fingers.

Anti-Offset Performance

A: High-temperature offset does not occur in the temperature region of the temperature as a standard for evaluating the low-temperature fixing performance+70° C. or more.

B: High-temperature offset does not occur in the temperature region of the temperature as a standard for evaluating the low-temperature fixing performance+60° C. or more.

C: High-temperature offset does not occur in the temperature region of the temperature as a standard for evaluating the low-temperature fixing performance+50° C. or more.

D: High-temperature offset does not occur in the temperature region of the temperature as a standard for evaluating the low-temperature fixing performance+40° C. or more.

E: High-temperature offset does not occur in the temperature region of the temperature as a standard for evaluating the low-temperature fixing performance+30° C. or more.

Anti-Soaking Performance

A: The difference in glossiness between the upper end area and the lower end area is less than 2.0 in respect of images formed at fixing temperature where the glossiness at the lower end area comes maximal.

B: The difference in glossiness between the upper end area and the lower end area is 2.0 or more to less than 4.0 in respect of images formed at fixing temperature where the glossiness at the lower end area comes maximal.

C: The difference in glossiness between the upper end area and the lower end area is 4.0 or more to less than 6.0 in respect of images formed at fixing temperature where the glossiness at the lower end area comes maximal.

D: The difference in glossiness between the upper end area and the lower end area is 6.0 or more to less than 8.0 in respect of images formed at fixing temperature where the glossiness at the lower end area comes maximal.

E: The difference in glossiness between the upper end area and the lower end area is 8.0 or more in respect of images formed at fixing temperature where the glossiness at the lower end area comes maximal.

Color Ranging Performance

A: The temperature region where C* is 55 or more is 50° C. or more.

B: The temperature region where C* is 55 or more is 40° C. or more.

C: The temperature region where C* is 55 or more is 30° C. or more.

D: The temperature region where C* is 55 or more is 20° C. or more.

E: The temperature region where C* is 55 or more is 10° C. or more.

Development Stabilizing Performance

A commercially available color laser printer (LBP-5500, manufactured by CANON INC.) was used. A toner of its cyan cartridge was taken out, and 150 g of each toner was filled in this cartridge. The cartridge was set at the cyan station, and a chart with a print percentage of 2% was continuously printed on image-receiving paper (OFFICE PLANNER 64 g/m$^2$, available from CANON INC.) in the normal-temperature and normal-humidity environment. When the remainder of the toner came to 50 g without causing any faulty images, 50 g of the toner was added to further perform the printing continuously. When the remainder of the toner further came to 50 g without causing any faulty images, 50 g of the toner was again added to perform the printing continuously, and this operation was repeated. The development stabilizing performance of the toner was evaluated according to the evaluation criteria shown below.

A: Faulty images come about when the quantity of the toner added is 200 g or more in total.

B: Faulty images come about when the quantity of the toner added is 150 g in total.

C: Faulty images come about when the quantity of the toner added is 100 g in total.

D: Faulty images come about when the quantity of the toner added is 50 g in total.

E: Faulty images come about without addition of any toner.

TABLE 1

| | Tg (° C.) | Mw | Mn | Dvp (nm) | $Dv_{10}$ (nm) | $Dv_{90}$ (nm) | $Dvp/Dv_{10}$ | $Dv_{90}/Dvp$ | Acid value Avp (mgKOH/g) | Avp × Dvp |
|---|---|---|---|---|---|---|---|---|---|---|
| Elastic Material Production Example 1 | 68 | 35,700 | 4,600 | 22.4 | 12 | 41 | 1.8 | 1.8 | 26.3 | 589 |
| Elastic Material Production Example 2 | 56 | 67,100 | 9,600 | 58.6 | 27 | 141 | 2.2 | 2.4 | 15.3 | 897 |
| Elastic Material Production Example 3 | 78 | 13,800 | 4,200 | 17.8 | 6 | 39 | 2.8 | 2.2 | 34.7 | 618 |
| Elastic Material Production Example 4 | 81 | 11,600 | 4,100 | 122.7 | 38 | 417 | 3.2 | 3.4 | 12.2 | 1,497 |
| Elastic Material Production Example 5 | 96 | 8,800 | 2,300 | 212.4 | 38 | 1,104 | 5.6 | 5.2 | 46.3 | 9,834 |

TABLE 1-2

| Elastic material | Sulfonic acid group content (ms. %) | Zeta potential Z1p (mV) | $Zlp/Z_{p10}$ | $Z_{p90}/Zlp$ | THF-soluble component content (ms. %) | Methanol-insoluble component content (ms. %) | Methanol-insoluble component acid value Avp2 (mgKOH/g) | Avp/Avp2 |
|---|---|---|---|---|---|---|---|---|
| Elastic material 1 | 2.54 | −82.3 | 1.24 | 1.13 | 96.8 | 91.2 | 22.1 | 1.19 |
| Elastic material 2 | 1.88 | −75.1 | 1.86 | 1.47 | 88.6 | 97.9 | 12.4 | 1.23 |
| Elastic material 3 | 3.13 | −88.4 | 2.62 | 2.31 | 94.1 | 88.3 | 21.4 | 1.62 |

TABLE 1-2-continued

| Elastic material | Sulfonic acid group content (ms. %) | Zeta potential Z1p (mV) | Zlp/$Z_{p10}$ | $Z_{p90}$/Zlp | THF-soluble component content (ms. %) | Methanol-insoluble component content (ms. %) | Methanol-insoluble component acid value Avp2 (mgKOH/g) | Avp/Avp2 |
|---|---|---|---|---|---|---|---|---|
| Elastic material 4 | 1.02 | −53.7 | 3.18 | 2.56 | 98.2 | 77.1 | 5.7 | 2.14 |
| Elastic material 5 | 0.34 | −34.8 | 2.78 | 3.02 | 100 | 68.9 | 15.2 | 3.05 |

TABLE 2

| | Alcohol monomers | | | Acid monomers | | | |
|---|---|---|---|---|---|---|---|
| | BPA-PO | BPA-EO | Ethylene glycol | Terephthalic acid | Trimellitic anhydride | Naphthalene dicarboxylic acid | 5-Sodium sulfoiso-phthalate |
| Elastic Material Production Example 1 | 40 | 5 | 70 | 95 | 5 | — | 4.8 |
| Elastic Material Production Example 2 | 40 | — | 90 | 85 | 15 | — | 3.6 |
| Elastic Material Production Example 3 | 50 | — | 55 | 98 | 7 | — | 6.2 |
| Elastic Material Production Example 4 | 20 | — | 85 | 99 | 1 | — | 1.6 |
| Elastic Material Production Example 5 | 5 | — | 115 | 20 | — | 80 | 0.7 |

TABLE 3

| | Toner | St (pbm) | Ba (pbm) | Initiator (pbm) | Elastic material No. | Amount as solid matter (pbm) | Heating temp. (° C.) | Heating time (hour) |
|---|---|---|---|---|---|---|---|---|
| Example: | | | | | | | | |
| 1 | Toner 1 | 59 | 41 | 4.0 | Elastic m. 1 | 4.2 | 66.0 | 2.0 |
| 2 | Toner 2 | 59 | 41 | 4.0 | Elastic m. 2 | 4.2 | 54.0 | 2.0 |
| 3 | Toner 3 | 59 | 41 | 4.0 | Elastic m. 1 | 4.2 | — | — |
| 4 | Toner 4 | 59 | 41 | 7.0 | Elastic m. 1 | 2.4 | 66.0 | 2.0 |
| 5 | Toner 5 | 59 | 41 | 4.0 | Elastic m. 2 | 2.4 | — | — |
| 6 | Toner 6 | 64 | 36 | 4.0 | Elastic m. 2 | 2.4 | — | — |
| 7 | Toner 7 | 49 | 51 | 3.2 | Elastic m. 1 | 4.8 | — | — |
| 8 | Toner 8 | 49 | 51 | 3.2 | Elastic m. 1 | 4.8 | 64.0 | 2.0 |
| 9 | Toner 9 | 49 | 51 | 3.2 | Elastic m. 3 | 6.4 | — | — |
| 10 | Toner 10 | 49 | 51 | 3.2 | Elastic m. 3 | 6.4 | 76.0 | 2.0 |
| 11 | Toner 11 | 71 | 29 | 2.4 | Elastic m. 4 | 6.4 | — | — |
| Comparative Example: | | | | | | | | |
| 1 | Toner 12 | 59 | 41 | 4.0 | — | — | 66.0 | 2.0 |
| 2 | Toner 13 | 59 | 41 | 4.0 | Elastic m. 1 | 4.2 | 66.0 | 2.0 |
| 3 | Toner 14 | 59 | 41 | 4.0 | Elastic m. 1 | 8.4 | 66.0 | 2.0 |
| 4 | Toner 15 | 59 | 41 | 4.0 | Elastic m. 1 | 4.2 | 66.0 | 2.0 |
| 5 | Toner 16 | 59 | 41 | 4.0 | Elastic m. 1 | 8.4 | 66.0 | 2.0 |
| 6 | Toner 17 | 59 | 41 | 4.0 | Elastic m. 5 | 4.2 | 66.0 | 2.0 |

TABLE 3-continued

| | Toner | St (pbm) | Ba (pbm) | Initiator (pbm) | Elastic material No. | Amount as solid matter (pbm) | Heating temp. (° C.) | Heating time (hour) |
|---|---|---|---|---|---|---|---|---|
| 7 | Toner 18 | 59 | 41 | 4.0 | Elastic m. 1 | 4.2 | 66.0 | 2.0 |
| 8 | Toner 19 | 59 | 41 | 4.0 | Elastic m. 1 | 4.2 | — | — |

pbm: parts by mass

TABLE 3-2

| | Colored particles | | | | | | | |
|---|---|---|---|---|---|---|---|---|
| | Glass transition point Tt (° C.) | Melting point Tw (° C.) | Ts − Tt (° C.) | Tw − Tt (° C.) | Weight average particle diam. D4t (μm) | D4t/D1t | Zeta potential Z2t (mV) | Z2t/Z1p (mV) |
| Example: | | | | | | | | |
| 1 | 34.3 | 81.7 | 33.8 | 47.4 | 4.1 | 1.14 | −41.6 | 40.7 |
| 2 | 33.2 | 81.7 | 23.1 | 48.5 | 4.1 | 1.14 | −41.6 | 33.5 |
| 3 | 35.2 | 81.7 | 32.9 | 46.5 | 4.1 | 1.14 | −41.6 | 40.7 |
| 4 | 33.3 | 81.7 | 34.8 | 48.4 | 4.3 | 1.17 | −40.8 | 41.5 |
| 5 | 36.3 | 81.8 | 20.0 | 45.5 | 4.1 | 1.14 | −41.6 | 33.5 |
| 6 | 40.4 | 81.8 | 15.9 | 41.4 | 4.4 | 1.18 | −40.5 | 34.6 |
| 7 | 24.4 | 81.7 | 43.7 | 57.3 | 4.5 | 1.23 | −38.2 | 44.1 |
| 8 | 23.3 | 81.6 | 44.8 | 58.3 | 4.5 | 1.23 | −38.2 | 44.1 |
| 9 | 25.2 | 81.7 | 52.9 | 56.5 | 4.5 | 1.23 | −38.2 | 50.2 |
| 10 | 22.8 | 81.8 | 55.3 | 59.0 | 4.5 | 1.23 | −38.2 | 50.2 |
| 11 | 44.7 | 81.7 | 36.5 | 37.0 | 4.9 | 1.26 | −36.1 | 17.6 |
| Comparative Example: | | | | | | | | |
| 1 | 34.0 | 81.8 | — | 47.8 | 4.1 | 1.14 | −41.6 | — |
| 2 | 34.0 | 81.7 | 34.1 | 47.7 | 4.2 | 1.31 | — | — |
| 3 | 34.0 | 81.7 | 34.1 | 47.7 | 4.1 | 1.37 | — | — |
| 4 | 34.0 | 81.7 | 34.1 | 47.7 | 4.1 | 1.14 | −41.6 | 40.7 |
| 5 | 34.0 | 81.8 | 34.1 | 47.8 | 4.1 | 1.14 | −41.6 | 40.7 |
| 6 | 34.0 | 81.7 | 61.8 | 47.7 | 4.1 | 1.14 | −41.6 | −6.8 |
| 7 | 33.0 | 81.8 | 35.1 | 48.8 | 3.9 | 1.27 | −12.2 | 70.1 |
| 8 | 34.0 | 81.7 | 34.1 | 47.7 | 4.1 | 1.14 | — | — |

TABLE 4

| | Toner | D4 (μm) | Average circularity | 1 μm or smaller particles content (no. %) | THF = Soluble component content (ms. %) | THF = insoluble & chloroform = soluble component content (ms. %) | Chloroform = insoluble component content (ms. %) | Of THF-soluble component Mw | Of THF-soluble component Mp | Physical properties of THF-insoluble & chloroform-soluble component: Acid value $Av_{c1}$ (mg KOH/g) | Polyester | Sulfur elem. content (ms. %) |
|---|---|---|---|---|---|---|---|---|---|---|---|---|
| Example: | | | | | | | | | | | | |
| 1 | No. 1 | 4.3 | 0.989 | 1.8 | 68.6 | 25.5 | 5.9 | 114,800 | 26,800 | 18.4 | Yes. | 0.186 |
| 2 | No. 2 | 4.3 | 0.988 | 2.9 | 72.3 | 22.0 | 5.7 | 106,700 | 24,400 | 16.3 | Yes. | 0.117 |
| 3 | No. 3 | 4.4 | 0.984 | 4.1 | 75.7 | 18.4 | 5.9 | 92,600 | 23,700 | 15.2 | Yes. | 0.051 |
| 4 | No. 4 | 4.6 | 0.989 | 2.1 | 69.9 | 24.4 | 5.7 | 58,300 | 16,200 | 12.4 | Yes. | 0.067 |
| 5 | No. 5 | 4.7 | 0.979 | 4.6 | 79.6 | 14.7 | 5.7 | 91,800 | 23,300 | 11.5 | Yes. | 0.038 |
| 6 | No. 6 | 5.2 | 0.978 | 4.8 | 79.7 | 14.6 | 5.7 | 91,700 | 23,100 | 11.3 | Yes. | 0.033 |
| 7 | No. 7 | 5.6 | 0.981 | 4.2 | 66.2 | 27.7 | 6.1 | 126,100 | 32,200 | 14.4 | Yes. | 0.071 |
| 8 | No. 8 | 5.6 | 0.987 | 3.4 | 63.9 | 30.0 | 6.1 | 134,600 | 33,900 | 21.7 | Yes. | 0.224 |
| 9 | No. 9 | 5.8 | 0.976 | 5.6 | 61.2 | 32.7 | 6.1 | 136,400 | 32,700 | 24.6 | Yes. | 0.305 |
| 10 | No. 10 | 5.8 | 0.979 | 4.1 | 58.4 | 35.5 | 6.1 | 147,200 | 34,500 | 28.3 | Yes. | 0.381 |
| 11 | No. 11 | 6.3 | 0.976 | 6.4 | 83.2 | 11.0 | 5.8 | 168,300 | 41,300 | 8.3 | Yes. | 0.016 |

TABLE 4-continued

| | Toner | D4 (μm) | Average circularity | 1 μm or smaller particles content (no. %) | THF = Soluble component content (ms. %) | THF = insoluble & chloroform = soluble component content (ms. %) | Chloroform = insoluble component content (ms. %) | Of THF-soluble component Mw | Of THF-soluble component Mp | Physical properties of THF-insoluble & chloroform-soluble component: Acid value $Av_{c1}$ (mg KOH/g) | Physical properties of THF-insoluble & chloroform-soluble component: Polyester | Physical properties of THF-insoluble & chloroform-soluble component: Sulfur elem. content (ms. %) |
|---|---|---|---|---|---|---|---|---|---|---|---|---|
| Comparative Example: | | | | | | | | | | | | |
| 1 | No. 12 | 4.2 | 0.989 | 1.8 | 87.9 | 0.8 | 5.3 | 85,300 | 20,600 | 0.4 | No. | 0 |
| 2 | No. 13 | 4.2 | 0.973 | 14.8 | 85.8 | 7.6 | 6.6 | 90,600 | 23,100 | 2.8 | Yes. | 0 |
| 3 | No. 14 | 4.1 | 0.972 | 21.1 | 84.7 | 8.6 | 6.7 | 92,700 | 23,600 | 3.5 | Yes. | 0 |
| 4 | No. 15 | 6.6 | 0.971 | 11.2 | 86.7 | 7.7 | 5.6 | 85,700 | 20,700 | 1.6 | No. | 0 |
| 5 | No. 16 | 6.3 | 0.968 | 16.3 | 85.9 | 8.2 | 5.9 | 85,800 | 20,700 | 2.2 | No. | 0 |
| 6 | No. 17 | 4.3 | 0.973 | 12.8 | 84.2 | 9.2 | 6.6 | 94,300 | 23,300 | 41.3 | Yes. | 0 |
| 7 | No. 18 | 4.4 | 0.972 | 10.5 | 87.3 | 7.4 | 5.3 | 85,800 | 20,800 | 0.7 | No. | 0 |
| 8 | No. 19 | 5.5 | 0.948 | 13.1 | 87.5 | 7.2 | 5.3 | 85,400 | 20,600 | 1.2 | No. | 0 |

TABLE 5

| | Toner | Ta (° C.) | Tb (° C.) | Tb − Ta (° C.) | Tc − Tb (° C.) | δa | δb | δc | δa − δb | G'a (Pa) | G'b (Pa) | G'a/G'b | G'a/G'c |
|---|---|---|---|---|---|---|---|---|---|---|---|---|---|
| Example: | | | | | | | | | | | | | |
| 1 | No. 1 | 42.1 | 61.1 | 19.0 | 18.0 | 0.97 | 0.19 | 0.92 | 0.78 | $2.96 \times 10^7$ | $7.90 \times 10^6$ | 3.7 | $1.44 \times 10^2$ |
| 2 | No. 2 | 41.1 | 59.1 | 18.0 | 27.0 | 1.02 | 0.34 | 1.67 | 0.68 | $2.98 \times 10^7$ | $4.79 \times 10^6$ | 6.2 | $4.99 \times 10^2$ |
| 3 | No. 3 | 43.1 | 62.1 | 19.0 | 21.0 | 0.95 | 0.33 | 0.91 | 0.62 | $2.80 \times 10^7$ | $4.65 \times 10^6$ | 6.0 | $1.88 \times 10^2$ |
| 4 | No. 4 | 41.1 | 61.1 | 20.0 | 14.0 | 0.97 | 0.27 | 0.81 | 0.70 | $1.60 \times 10^7$ | $4.17 \times 10^6$ | 3.8 | $9.20 \times 10^1$ |
| 5 | No. 5 | 44.2 | 62.1 | 17.9 | 17.5 | 1.08 | 0.37 | 1.33 | 0.71 | $1.59 \times 10^7$ | $2.92 \times 10^6$ | 5.4 | $2.11 \times 10^2$ |
| 6 | No. 6 | 48.1 | 62.1 | 14.0 | 23.0 | 0.92 | 0.39 | 1.11 | 0.53 | $2.83 \times 10^7$ | $5.89 \times 10^6$ | 4.8 | $2.95 \times 10^2$ |
| 7 | No. 7 | 31.7 | 60.1 | 28.4 | 13.0 | 1.06 | 0.28 | 1.03 | 0.78 | $1.39 \times 10^7$ | $1.50 \times 10^6$ | 9.3 | $1.62 \times 10^2$ |
| 8 | No. 8 | 30.5 | 58.1 | 27.6 | 19.0 | 0.89 | 0.18 | 0.75 | 0.71 | $2.53 \times 10^7$ | $4.39 \times 10^6$ | 5.8 | $1.74 \times 10^2$ |
| 9 | No. 9 | 33.0 | 62.1 | 29.1 | 11.0 | 1.02 | 0.37 | 1.41 | 0.65 | $1.68 \times 10^7$ | $1.47 \times 10^6$ | 11.4 | $7.34 \times 10^1$ |
| 10 | No. 10 | 30.5 | 58.1 | 27.6 | 15.0 | 0.86 | 0.20 | 1.00 | 0.66 | $2.63 \times 10^7$ | $4.37 \times 10^6$ | 6.0 | $2.27 \times 10^1$ |
| 11 | No. 11 | 52.5 | 65.3 | 12.8 | 31.0 | 1.37 | 0.48 | 2.76 | 0.89 | $4.36 \times 10^7$ | $2.83 \times 10^6$ | 15.4 | $2.60 \times 10^1$ |
| Comparative Example: | | | | | | | | | | | | | |
| 1 | No. 12 | 44.1 | 61.1 | 17.0 | 20.0 | 1.23 | 0.65 | 1.36 | 0.58 | $1.59 \times 10^7$ | $1.65 \times 10^6$ | 9.6 | $2.53 \times 10^2$ |
| 2 | No. 13 | 43.8 | 61.2 | 17.4 | 19.9 | 1.21 | 0.65 | 1.35 | 0.56 | $1.62 \times 10^7$ | $1.67 \times 10^6$ | 9.7 | $2.02 \times 10^2$ |
| 3 | No. 14 | 43.7 | 61.3 | 17.6 | 20.0 | 1.18 | 0.65 | 1.21 | 0.53 | $1.97 \times 10^7$ | $2.21 \times 10^6$ | 8.9 | $1.67 \times 10^2$ |
| 4 | No. 15 | 43.1 | 61.2 | 18.1 | 19.9 | 1.12 | 0.64 | 1.18 | 0.48 | $2.18 \times 10^7$ | $2.43 \times 10^6$ | 9.0 | $1.66 \times 10^2$ |
| 5 | No. 16 | 43.0 | 61.1 | 18.1 | 20.0 | 1.11 | 0.64 | 1.11 | 0.47 | $2.20 \times 10^7$ | $2.46 \times 10^6$ | 8.9 | $1.64 \times 10^2$ |
| 6 | No. 17 | 46.2 | 61.8 | 15.6 | 41.8 | 1.41 | 0.63 | 3.16 | 0.78 | $4.83 \times 10^7$ | $5.59 \times 10^6$ | 8.6 | $1.34 \times 10^1$ |
| 7 | No. 18 | 43.6 | 61.1 | 17.5 | 20.0 | 1.45 | 0.64 | 3.84 | 0.81 | $5.23 \times 10^7$ | $5.64 \times 10^6$ | 9.3 | $2.84 \times 10^1$ |
| 8 | No. 19 | 44.0 | 61.2 | 17.2 | 20.1 | 1.22 | 0.65 | 1.28 | 0.57 | $1.60 \times 10^7$ | $1.65 \times 10^6$ | 9.7 | $1.68 \times 10^2$ |

TABLE 5-2

| Toner | Physical properties by temp. (x-axis)-$\log_{10}$G' gradient(y-axis) curve: Tx(° C.) | Ty(° C.) | Tz(° C.) | Physical properties by temp. T(° C.)(x-axis)-agglomeration degree A(%)(y-axis) curve: $A_0$(%) | $T_1$(° C.) | $T_1$ − Ta(° C.) | $T_2$(° C.) | α |
|---|---|---|---|---|---|---|---|---|
| Toner 1 | 40.6 | 59.6 | 77.3 | 9.9 | 60.4 | 18.3 | 63.1 | 28.9 |
| Toner 2 | 39.8 | 56.2 | 84.3 | 10.8 | 59.2 | 18.1 | 62.5 | 23.4 |
| Toner 3 | 41.8 | 60.0 | 81.3 | 11.7 | 59.3 | 16.2 | 62.8 | 21.8 |
| Toner 4 | 39.9 | 58.9 | 73.3 | 10.3 | 55.4 | 14.3 | 57.6 | 35.3 |
| Toner 5 | 43.2 | 57.8 | 77.8 | 12.3 | 54.9 | 10.7 | 56.9 | 37.9 |
| Toner 6 | 47.1 | 57.6 | 83.3 | 12.4 | 57.7 | 9.6 | 59.5 | 42.0 |
| Toner 7 | 30.7 | 57.6 | 71.3 | 12.0 | 58.1 | 26.4 | 62.4 | 17.7 |
| Toner 8 | 29.5 | 56.2 | 75.3 | 11.5 | 59.3 | 28.8 | 63.5 | 18.2 |
| Toner 9 | 31.9 | 61.1 | 68.3 | 13.7 | 64.1 | 31.1 | 68.6 | 16.5 |
| Toner 10 | 29.4 | 56.9 | 70.6 | 12.2 | 62.8 | 32.3 | 67.5 | 16.1 |
| Toner 11 | 51.7 | 63.1 | 91.2 | 14.8 | 59.2 | 6.7 | 63.9 | 15.6 |
| Toner 12 | 42.9 | 54.2 | 69.4 | 10.1 | 38.9 | −5.2 | 40.3 | 55.6 |
| Toner 13 | 42.8 | 55.3 | 71.6 | 18.4 | 40.7 | −3.1 | 45.8 | 13.6 |

TABLE 5-2-continued

| Toner | Physical properties by temp. (x-axis)-$\log_{10}$G' gradient(y-axis) curve | | | Physical properties by temp. T(° C.)(x-axis)-agglomeration degree A(%)(y-axis) curve | | | | |
|---|---|---|---|---|---|---|---|---|
| | Tx(° C.) | Ty(° C.) | Tz(° C.) | $A_0$(%) | $T_1$(° C.) | $T_1$ – Ta(° C.) | $T_2$(° C.) | α |
| Toner 14 | 43.2 | 55.8 | 72.1 | 19.1 | 42.3 | −1.4 | 48.1 | 11.9 |
| Toner 15 | 42 | 56.1 | 73.3 | 16.2 | 38.7 | −4.4 | 40.1 | 51.3 |
| Toner 16 | 42.1 | 56.5 | 74.1 | 21.5 | 39.2 | −3.8 | 40.5 | 51.2 |
| Toner 17 | 45.7 | 57.9 | 93.8 | 18.3 | 45.9 | −0.3 | 47.4 | 46.5 |
| Toner 18 | 42.7 | 57.1 | 74.9 | 16.2 | 45.4 | 1.8 | 51.4 | 12.0 |
| Toner 19 | 43.2 | 56.4 | 73.7 | 18.7 | 43.6 | −0.4 | 48.6 | 13.9 |

TABLE 6

| | Anti-blocking performance | Low-temperature fixing performance | Anti-offset performance | Development stabilizing performance | Anti-soaking performance | Color ranging performance |
|---|---|---|---|---|---|---|
| Example: | | | | | | |
| 1 | A | A | A | A | A | A |
| 2 | A | A | A | A | B | A |
| 3 | A | A | B | A | B | B |
| 4 | A | A | C | A | B | A |
| 5 | B | A | B | A | C | B |
| 6 | B | B | B | B | C | B |
| 7 | A | A | C | A | B | B |
| 8 | A | A | B | A | B | A |
| 9 | A | A | C | A | B | B |
| 10 | A | A | B | A | A | B |
| 11 | A | C | B | B | B | C |
| Comparative Example: | | | | | | |
| 1 | D | A | C | E | E | C |
| 2 | C | A | C | D | E | C |
| 3 | B | A | B | E | E | C |
| 4 | C | A | C | E | D | B |
| 5 | B | A | B | D | D | C |
| 6 | A | B | B | C | D | D |
| 7 | A | B | B | D | D | C |
| 8 | B | B | C | D | E | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2008-042969, filed on Feb. 25, 2008, which is herein incorporated by reference as part of this application.

What is claimed is:

1. A process for preparing a toner comprising the steps of:

forming a first liquid dispersion by dispersing a colored particle into an aqueous medium containing a sparingly water-soluble inorganic dispersant, the colored particle comprising a binder resin, a colorant and a wax, in which a surface of the colored particle is coated with the sparingly water-soluble inorganic dispersant;

adding an elastic material particle to the first liquid dispersion, and forming a second liquid dispersion in which the colored particle whose surface is coated with the elastic material particle is dispersed, the sparingly water-soluble inorganic dispersant existing between the surface of the colored particle and the elastic material particle;

heating the second liquid dispersion to soften the colored particle and the elastic material particle; and removing the sparingly water-soluble inorganic dispersant by dissolving into the aqueous medium while maintaining softened state of the colored particle and the elastic material particle and forming a coat layer made from the elastic material particle coating the colored particle directly, wherein the colored particle has a glass transition point (Tt) from 25.0° C. to 60.0° C. and the elastic material particles has a glass transition point (Ts) from 40.0° C. to 90.0° C., wherein Ts−Tt is from 5.0° C. to 50.0° C., wherein the elastic material particle has a zeta potential (Z1p) of from −110.0 mV to −35.0 mV; a dispersoid which has the colored particle and the sparingly water-soluble inorganic dispersant in the step of forming the first liquid dispersion, having a zeta potential Z2t (mV) of −15.0 mV or less; and a difference between the Z2t and the Z1p, Z2t−Z1p, of from 5.0 mV to 50.0 mV, wherein the toner comprises (a) a toner base particle containing at least the binder resin, the colorant and the wax, and an elastic material with which the toner base particle is coated on its surface and which is made from the elastic material particle, and (b) an inorganic fine powder, wherein in a loss tangent (tan δ) curve obtained by a dynamic viscoelasticity test of the toner, the tan δ showing a maximal value δa in the temperature region of from 28.0° C. to 60.0° C., which maximal value δa is 0.50 or more, and showing a minimal value δb in the temperature region of from 45.0° C. to 85.0° C., which minimal value δb is 0.60 or less, where the difference between the maximal value δa and the minimal value δb, δa−δb, is 0.20 or more; and, where the temperature that affords the maximal value δa is represented by Ta (° C.) and the temperature that affords the minimal value δb is represented by Tb (° C.), the difference between the Ta and the Tb, Tb−Ta, being from 5.0° C. to 45.0° C., and wherein the toner has, in a storage elastic modulus (G') curve obtained by the dynamic viscoelasticity test, a value G'a of a storage elastic modulus at the Ta, of from 1.00×106 Pa to $5.00\times10^7$ Pa.

2. The process for preparing a toner according to claim 1, wherein the toner has, in the storage elastic modulus (G') curve obtained by the dynamic viscoelasticity test, a value G'b of a storage elastic modulus at the Tb and the G'a in a ratio (G'a/G'b) of 50.0 or less.

3. The process for preparing a toner according to claim 1, wherein, in the tan δ curve, the tan δ shows a maximal value δc in a temperature region exceeding the Tb (° C.), which maximal value δc is 10.00 or less, and, when the temperature that affords the maximal value δc is represented by Tc (° C.), the difference between the Tc and the Tb, Tc−Tb, is from 5.0° C. to 80.0° C.

4. The process for preparing a toner according to claim 3, wherein the toner has, in the storage elastic modulus (G') curve obtained by the dynamic viscoelasticity test, a value G'c of a storage elastic modulus at the Tc and the G'c in a ratio (G'a/G'c) of from $1.00\times10^1$ to $1.00\times10^4$.

5. The process for preparing a toner according to claim 1, wherein the toner contains from 50.0% by mass to 93.0% by mass of a THF-soluble component which dissolves in tetrahydrofuran (THF) when Soxhlet extraction is effected, and contains from 5.0% by mass to 45.0% by mass of a component which is insoluble in THF and soluble in chloroform when Soxhlet extraction is effected.

6. The process for preparing a toner according to claim 5, wherein the THF-soluble component has a maximal value (Mp) at a molecular weight of from 8,000 to 200,000 and has a weight average molecular weight (Mw) of from 10,000 to 500,000, in molecular weight distribution measured in terms of polystyrene (St) by gel permeation chromatography (GPC).

7. The process for preparing a toner according to claim 5, wherein the component insoluble in THF and soluble in chloroform has an acid value of from 5.0 mgKOH/g to 50.0 mgKOH/g.

8. The process for preparing a toner according to claim 5, wherein the component insoluble in THF and soluble in chloroform contains a sulfur element derived from a sulfonic acid group.

9. The process for preparing a toner according to claim 1, wherein, where the storage elastic modulus (G') found by the dynamic viscoelasticity test is converted into a common logarithm ($\log_{10}$ G') and in a temperature-gradient curve where the gradient of the $\log_{10}$ G' at each temperature is set on the y-axis and the temperature at that time is set on the x-axis, the $\log_{10}$ G' shows a minimal value at a temperature Tx (° C.) in the temperature region of from 25.0° C. to 60.0° C., shows a maximal value at a temperature Ty (° C.) in the temperature region of from 45.0° C. to 80.0° C. and shows a minimal value at a temperature Tz (° C.) in the temperature region of from 60.0° C. to 100.0° C., and the Tx (° C.), the Ty (° C.) and the Tz (° C.) satisfy the relationship of:

$$Tx<Ty<Tz.$$

10. The process for preparing a toner according to claim 1, wherein the elastic material contains a sulfonic acid type functional group in an amount of from 0.10% by mass to 10.00% by mass based on the mass of the elastic material.

11. The process for preparing a toner according to claim 1, wherein the elastic material is contained in an amount of from 1.0% by mass to 25.0% by mass based on the total mass of the toner.

12. The process for preparing a toner according to claim 1, wherein the colored particle has a glass transition point (Tt) at from 25.0° C. to 60.0° C. and a melting point (Tw) at from 65.0° C. to 95.0° C., and the elastic material has a glass transition point (Ts) at from 40.0° C. to 90.0° C., where a difference between the Tt and the Tw, Tw−Tt, is from 10.0° C. to 50.0° C. and a difference between the Tt and the Ts, Ts−Tt, is from 5.0° C. to 50.0° C.

13. The process for preparing a toner according to claim 3, wherein the toner has, where the degree of agglomeration at a temperature of 23.0° C. and a humidity of 60% is represented by A0 (%), an A0 (%) of 70.0% or less, and has, where the temperature at which the degree of agglomeration of the toner comes to A0+10.0% is represented by T1 (° C.) and the temperature at which the degree of agglomeration comes to 98.0% is represented by T2 (° C.), a difference between the T1 (° C.) and the Ta (° C.), T1−Ta, of from 2.0° C. to 40.0° C., and has a rate of change in the degree of agglomeration at the T1 (° C.) and at the T2 (° C.), $\alpha=\{98.0-(A0+10.0)\}/(T2-T1)$, of from 15.0 to 50.0.

* * * * *